US012740589B2

(12) United States Patent
Watanabe

(10) Patent No.: US 12,740,589 B2
(45) Date of Patent: Sep. 22, 2026

(54) AROMATIC CARTRIDGE

(71) Applicant: Future Technology Co., Ltd., Kagoshima (JP)

(72) Inventor: Ryuji Watanabe, Tokyo (JP)

(73) Assignee: Future Technology Co., Ltd., Izumi (JP)

( * ) Notice: Subject to any disclaimer, the term of this patent is extended or adjusted under 35 U.S.C. 154(b) by 812 days.

(21) Appl. No.: 18/026,378

(22) PCT Filed: Aug. 11, 2021

(86) PCT No.: PCT/JP2021/029654
§ 371 (c)(1),
(2) Date: Oct. 3, 2023

(87) PCT Pub. No.: WO2022/059391
PCT Pub. Date: Mar. 24, 2022

(65) Prior Publication Data

US 2024/0049788 A1 Feb. 15, 2024

(30) Foreign Application Priority Data

Sep. 16, 2020 (JP) ..... 2020-155835

(51) Int. Cl.
*A24F 40/42* (2020.01)
*A24B 15/16* (2020.01)
(Continued)

(52) U.S. Cl.
CPC ..... *A24F 40/42* (2020.01); *A24B 15/16* (2013.01); *A24B 15/301* (2013.01); *A24D 3/17* (2020.01)

(58) Field of Classification Search
None
See application file for complete search history.

(56) References Cited

U.S. PATENT DOCUMENTS

2016/0037823 A1 2/2016 Ruben
2017/0014582 A1* 1/2017 Skoda ..... A61M 15/0065
(Continued)

FOREIGN PATENT DOCUMENTS

CN 108348014 A * 7/2018 ..... A61M 15/06
EP 3698651 A1 8/2020
(Continued)

OTHER PUBLICATIONS

English machine translation of Rado CN108348014A published Jul. 31, 2018; A61M15/06; 13 pages. (Year: 2018).*
(Continued)

*Primary Examiner* — Linda L Gray
(74) *Attorney, Agent, or Firm* — Yokoi & Co., U.S.A.; Toshiyuki Yokoi

(57) ABSTRACT

Provided is an aromatic cartridge with which it is possible for a cannabinoid to be taken in through smoking. The aromatic cartridge is mounted in an inhalation implement having an electric heating means and generates an aerosol through being heated by the electric heating means. The aromatic cartridge has a tubular cover, an aromatic base material that is accommodated in one end of the cover and that generates an aromatic-component-containing aerosol through being heated, a filter that is accommodated in the other end of the cover, and a cannabinoid-containing substance. The aromatic cartridge contains the cannabinoid-containing substance in one or more locations either as a liquid or solid, or in an encapsulated form.

6 Claims, 16 Drawing Sheets

(51) Int. Cl.
*A24B 15/30* (2006.01)
*A24D 3/17* (2020.01)

(56) References Cited

U.S. PATENT DOCUMENTS

| | | | | |
|---|---|---|---|---|
| 2019/0022158 | A1 | 1/2019 | Greenbaum et al. | |
| 2019/0070396 | A1 * | 3/2019 | Johnson | A61K 31/137 |
| 2020/0253269 | A1 | 8/2020 | Rousseau et al. | |
| 2021/0267266 | A1 | 9/2021 | Park et al. | |

FOREIGN PATENT DOCUMENTS

| | | | | |
|---|---|---|---|---|
| JP | 2018-78805 | A | 5/2018 | |
| JP | 6705042 | B | 6/2020 | |
| JP | 6705042 | B1 | 6/2020 | |
| JP | 2020-110045 | A | 7/2020 | |
| WO | WO-2019215719 | A1 * | 11/2019 | A61M 11/02 |
| WO | 2020/028468 | A | 2/2020 | |
| WO | 2020/091394 | A | 5/2020 | |
| WO | 2020/169440 | A1 | 8/2020 | |
| WO | WO-2020169957 | A1 * | 8/2020 | A24F 40/42 |

OTHER PUBLICATIONS

Extended European Search Report dated Aug. 22, 2024.
PCT International Preliminary Report on Patentability and Written Opinion of the International Searching Authority dated Oct. 12, 2021 filed in PCT/JP2021/029654.
International Search Report (ISR) dated Oct. 12, 2021 filed in PCT/JP2021/029654.
Written Opinion of the International Searching Authority dated Oct. 12, 2021 filed in PCT/JP2021/029654.

* cited by examiner

AROMATIC CARTRIDGE

TECHNICAL FIELD

The present invention relates to an aromatic cartridge that is mounted in an inhalation implement having an electric heating means and that can generate an aromatic-component-containing aerosol through being heated by the electric heating means.

BACKGROUND ART

It has been confirmed that cannabinoids have utility in terms of calming and painkilling actions. In order to obtain such utility, a cannabinoid is added to a cartridge of an electronic cigarette in which a liquid is heated to thereby generate vapor.

Patent Document 1 discloses a liquid composition for an electronic cigarette, the liquid composition containing at least a cannabinoid contained in *cannabis* stems or seeds, caffeine, and a solvent, as an example of using such cannabinoids.

RELATED ART DOCUMENTS

Patent Documents

Patent Document 11: Japanese Laid-Open Patent Application No. 2020-110045

DISCLOSURE OF THE INVENTION

Problems the Invention is Intended to Solve

In an electronic cigarette such as that disclosed in Patent Document 1, a liquid to which a flavor or the like is added is heated, whereby a vapor is produced. However, in a heated tobacco product, an aerosol generated from a base material is inhaled, the base material including, inter alia, dried plant matter such as tobacco leaves or black tea leaves, and an aerosol former that can generate an aerosol through being heated. Because what is heated to produce the vapor in the electronic cigarette is a liquid, a problem is presented in that the flavor of the vapor is less complex than that of an aerosol in a heated tobacco product.

The present invention was contrived in view of the aforementioned problem, it being an object of the present invention to provide an aromatic cartridge with which it is possible to take in a cannabinoid by smoking.

Means for Solving the Problems

The present invention relates to an aromatic cartridge that is mounted in an inhalation implement having an electric heating means and that generates an aerosol through being heated by the electric heating means, characterized by having a tubular cover, an aromatic base material that is accommodated in one end of the cover and that generates an aromatic-component-containing aerosol through being heated, a filter that is accommodated in the other end of the cover, and a cannabinoid-containing substance, the aromatic cartridge containing the cannabinoid-containing substance in one or more locations either as a liquid or solid, or in an encapsulated form.

In the present invention, the cannabinoid-containing substance is configured in a liquid or solid form and contained in the aromatic base material pulverized and dried the filter, or is encapsulated and contained in one or more locations in the aromatic cartridge, thereby making it possible to incorporate a cannabinoid into the aerosol generated from the aromatic base material. As a result, a user can inhale a vaporized cannabinoid and an aromatic component generated from the aromatic base material together with the aerosol, and can anticipate the physiologically active effects of the cannabinoid while enjoying the scent of the aromatic component.

In the aromatic cartridge according to the present invention, it is preferable that: the aromatic base material includes a pulverized and dried plant matter, an aerosol former, and a sorbent that allows sorption of the cannabinoid-containing substance onto the aromatic base material; and the cannabinoid is contained mixed in a raw material of the aromatic base material. In addition, the sorbent preferably includes at least one of crosslinked polyvinylpyrrolidone pulverized and dried a cyclodextrin.

In the aspect described above, the cannabinoid is contained mixed in the raw material of the aromatic base material, whereby the aromatic component generated from the aromatic base material and the vaporized cannabinoid are released together with the aerosol when the aromatic base material is heated. Therefore, the user can efficaciously inhale the cannabinoid while enjoying the scent of the aromatic component.

In the aromatic cartridge according to the present invention, it is preferable that: the aromatic cartridge includes the tubular cover, the aromatic base material, the filter, and a support member disposed between the aromatic base material and the filter; and the cannabinoid-containing substance is disposed in an encapsulated form in at least one location selected from among (a) inside the aromatic base material, (b) between the aromatic base material and the support member, (c) inside the support member, (d) between the support member and the filter, and (e) inside the filter.

In the aspect described above, because the cannabinoid-containing substance is disposed in the encapsulated form, the capsule melts through heating or breaks during smoking, and the cannabinoid-containing substance is released. Therefore, the user can inhale the cannabinoid in high concentrations and can anticipate higher physiologically active effects.

In the aromatic cartridge according to the present invention, the cannabinoid contained in the cannabinoid-containing substance is preferably cannabidiol.

In the aspect described above, a variety of physiologically active effects can be anticipated because cannabidiol is known to exhibit anxiolytic effects, antiepileptic effects, nerve protection, vasorelaxation, anticonvulsant effects, anti-ischemic effects, anticancer effects, antiemetic effects, antibacterial effects, antidiabetic effects, anti-inflammatory effects, promotion of bone growth, and other effects.

In the aromatic cartridge according to the present invention, the cannabinoid-containing substance is preferably contained dissolved in a solvent selected from oils and fats and alcohol-based solvents.

In the aspect described above, the cannabinoid-containing substance is contained dissolved in a solvent selected from oils and fats and alcohol-based solvents, thereby making it possible to facilitate mixing or impregnation of the aromatic base material or the filter with the cannabinoid-containing material, or to facilitate encapsulation.

The aromatic cartridge according to the present invention preferably contains at least one selected from menthol, caffeine, catechins, and perfumes in addition to the cannabinoid-containing substance.

In the aspect described above, at least one selected from menthol, caffeine, catechins, and perfumes is contained in addition to the cannabinoid, thereby making it possible to furthermore impart a refreshing feel, an awakening effect, a deodorizing effect, an antibacterial effect, a flavor, and the like.

In the aromatic cartridge according to the present invention, the aromatic base material preferably includes a molding agent for reinforcing physical strength.

Effect of the Invention

In the aromatic cartridge according to the present invention, because the aromatic cartridge contains the cannabinoid-containing substance in one or more locations, a user can take in the cannabinoid through smoking.

MODE FOR CARRYING OUT THE INVENTION

Embodiment 1

Figure 1:
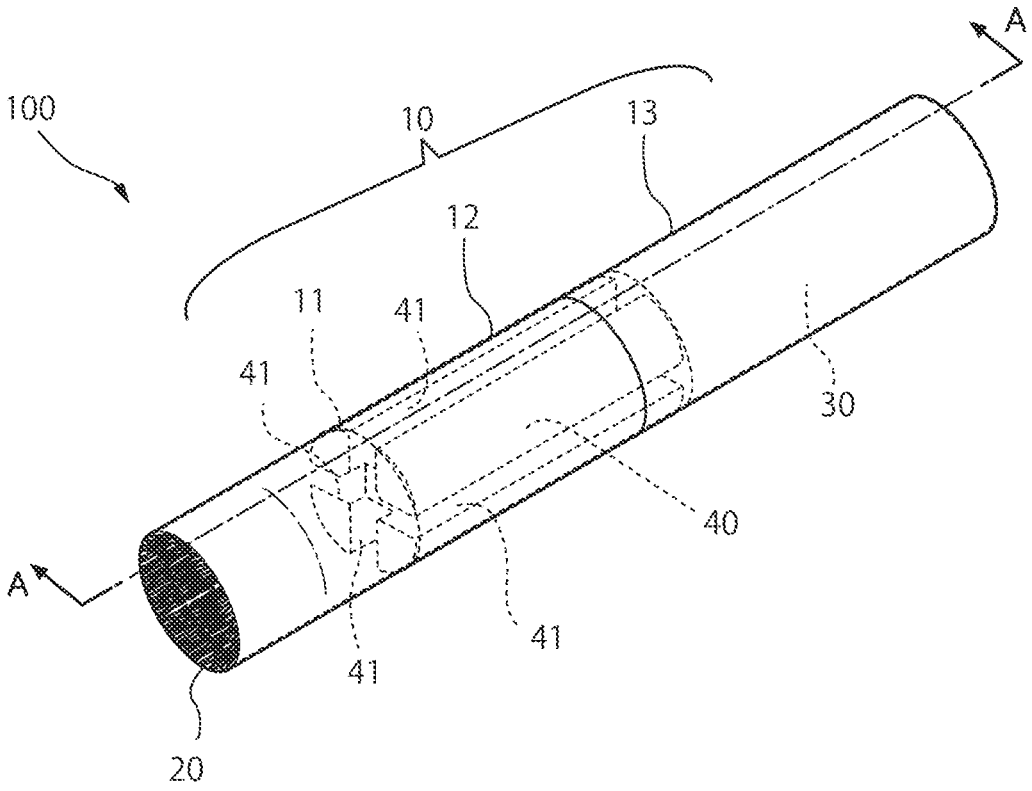
FIG. 1 is a perspective view of an aromatic cartridge according to one embodiment of the present invention.
Figure 2:
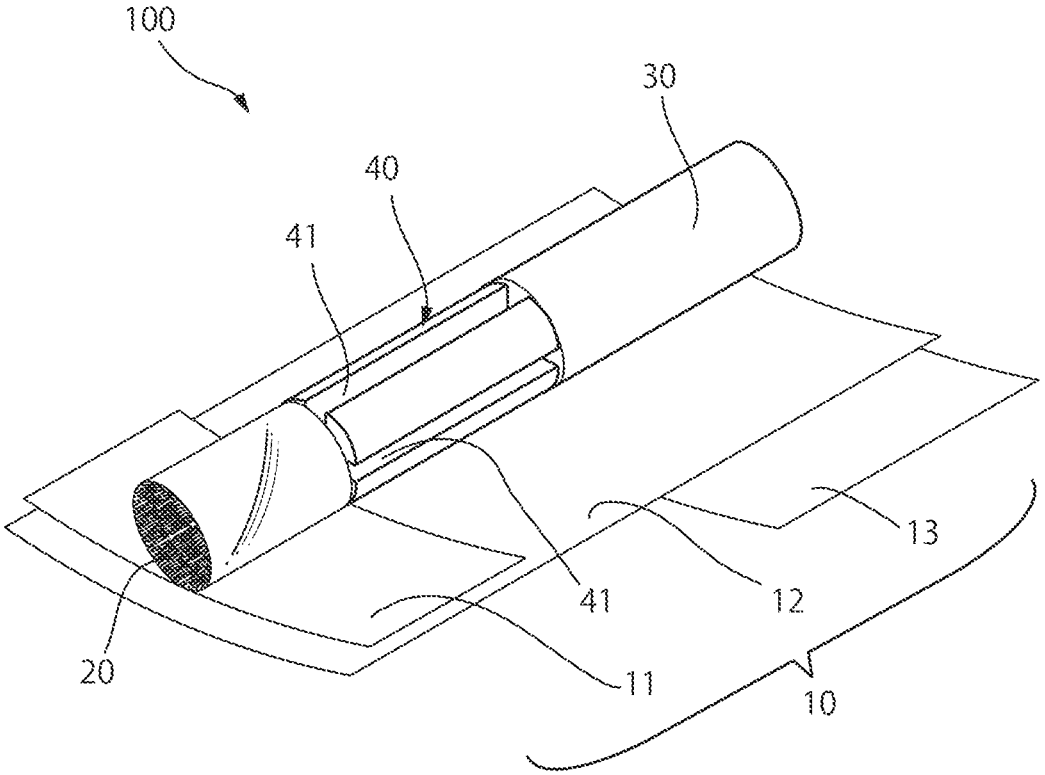
FIG. 2 is a development perspective view of the aromatic cartridge.
Figure 3:
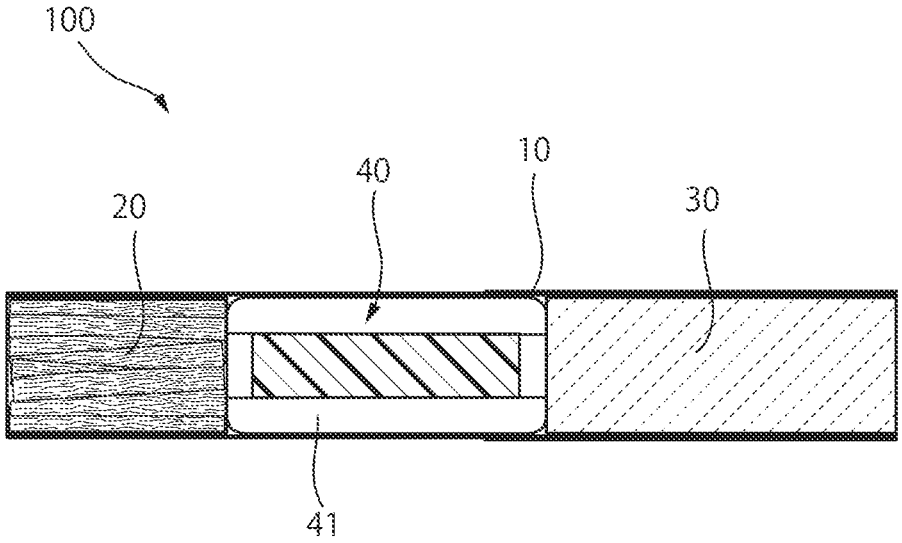
FIG. 3 is an enlarged cross-sectional view taken along line A-A in FIG. 1.
Figure 4:
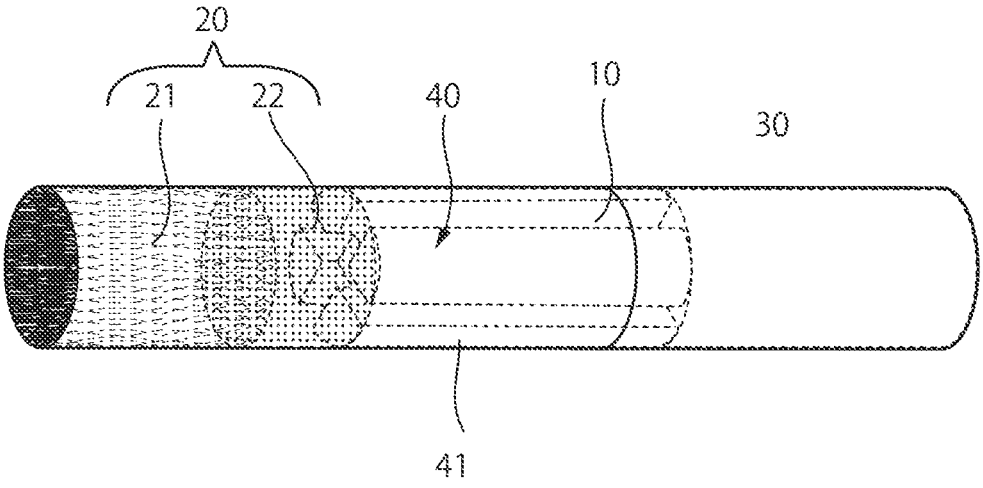
FIG. 4 is a perspective view of the aromatic cartridge.

One embodiment of an aromatic cartridge according to the present invention is described below with reference to the accompanying drawings. FIG. 1 is a perspective view of the aromatic cartridge according to the present embodiment. FIG. 2 is a development perspective view of the aromatic cartridge. FIG. 3 is an enlarged cross-sectional view taken along line A-A in FIG. 1. FIG. 4 is a perspective view of the aromatic cartridge according to the present embodiment.

(Configuration of Aromatic Cartridge 100)

As shown in FIGS. 1 and 2, the aromatic cartridge 100 can be used as a cartridge in a heated tobacco product. An example is described below in which the aromatic cartridge 100 is used in a heated tobacco product that is an inhalation implement having an electric heating means.

The aromatic cartridge 100 has a tubular cover 10, an aromatic base material 20 accommodated in one end of the cover 10, a filter 30 accommodated in the other end of the cover 10, and a support member 40 that is accommodated in the cover 10 and positioned between the aromatic base material 20 and the filter 30. In the present example, the aromatic base material 20, the support member 40, and the filter 30 are provided in the stated order from the one end of the cover 10 to the other end thereof along the axial direction.

The cover 10 is configured from: a paper roll 11 that covers the aromatic base material 20; a base material 12 that covers the aromatic base material 20, the support member 40, and the filter 30 from outside of the paper roll 11; and tip paper 13 that furthermore covers an outer peripheral portion of the filter 30 from outside of the base material 12. The base material 12 is joined to the paper roll 11 and the tip paper 13 through adhesion, melting with heat, or another means.

The paper roll 11, the base material 12, and the tip paper 13 can be configured from, e.g., paper, synthetic resin film, metal foil, or the like, and may be composite sheets in which such materials are laminated. In addition, an adhesive agent layer, hot-melt layer, or other adhesive or meltable layer may be formed on the inner surfaces of the paper roll 11, the base material 12, and the tip paper 13.

In the present embodiment, the paper roll 11 serves to consolidate the aromatic base material 20 into a columnar shape. The base material 12 serves to link the aromatic base material 20, the support member 40, and the filter 30. The tip paper 13 serves to reinforce a portion (mouthpiece) where a user holds the aromatic cartridge 100 in their mouth. The cover 10 is not limited to being an article in which the paper roll 11, the base material 12, and the tip paper 13 are configured separately, but rather may be configured from a single sheet in which the paper roll 11, the base material 12, and the tip paper 13 are integrated.

In the present example, the aromatic base material 20, the support member 40, and the filter 30 are provided in the stated order from the one end of the cover 10 to the other end thereof along the axial direction, as shown in FIGS. 2 and 3.

The aromatic base material 20 is a grouping of constituent elements that are formed as, e.g., rods, strips, powders, granules, pellets, fragments, sheets, fibers, porous materials, or blocks. In the present embodiment, the aromatic base material 20 is formed in an overall cylindrical shape from strip-form constituent elements.

The aromatic base material 20 is capable of generating an aerosol through being heated by an electric heating means of a heated smoking implement. As the aromatic base material 20, an article that contains a pulverized and dried plant matter having not only tobacco plants but also non-tobacco plants as raw materials, an aerosol former that can generate an aerosol, and a heat-meltable substance that melts due to being heated is preferably used. The configuration of the aromatic base material 20 shall be described later.

As the filter 30, an article that has a fixed permeability with respect to the aerosol or mainstream smoke generated from the aromatic base material 20, and that has functions for capturing solid particles contained in the mainstream smoke or aerosol and absorbing harmful components or the like, is preferably used. There is no particular limitation as to the shape of the filter 30; for example, the filter 30 may be of any shape that can be encompassed by the cover 10.

Examples of articles that can be used as the filter 30 include acetate filters in which acetate fiber is used, charcoal filters in which activated charcoal is contained in an acetate filter, and advanced filter technology (AFT) (registered trademark) having a plurality of grooves formed so as to be recessed from the outer peripheral surface of the filter 30 over the entire axial direction of the cover 10. In the present embodiment, the filter 30 is secured to the inner peripheral surface of the base material 12 of the cover 10 through adhesion, welding, or another securing means.

The support member 40 is located between the aromatic base material 20 and the filter 30 and is positioned adjacent to each of these constituent elements. The support member 40 can be of a shape having an outer peripheral surface that corresponds to the shape of the inner peripheral surface of the cover 10. In the present embodiment, the support member 40 is formed in an overall cylindrical shape. The support member 40 is secured to the cover 10 through adhesion, welding, or another securing means. In the present embodiment, the support member 40 is secured to the inner peripheral surface of the base material 12.

There is no particular limitation as to the shape of the support member 40, provided that the support member 40 has a structure that allows passage of air from one end to the other end thereof and has a function for restricting movement of the aromatic base material 20 toward the other-end side.

In the present embodiment, the support member 40 has one or a plurality of air-passage paths 41 passing therethrough in the axial direction. Moreover, in the present embodiment, the air-passage paths 41 are demarcated by the inner peripheral surface of the cover 10 and four recessed grooves that are formed, in the outer peripheral surface of the support member 40, along the axial direction and evenly spaced in the circumferential direction.

The air-passage paths 41 may also be configured from, e.g., one or a plurality of through-holes formed so as to pass through in the axial direction from one end surface to the other end surface of the support member 40. The air-passage paths 41 may additionally be configured from, e.g., a central air-passage path formed along the axial center of the support member 40, and a plurality of air-passage paths that are disposed lined up in the circumferential direction so as to surround the central air-passage path and that are formed so as to pass through in the same axial direction.

The support member 40 may also be configured from, inter alia, a honeycomb structure having a hexagonal end-surface shape for partition walls and having a plurality of air-passage paths passing therethrough in the axial direction. Furthermore, the support member 40 may be configured from, e.g., a porous body in which continuous voids are formed.

The support member 40 is preferably of such shape as to be capable of restricting movement of the aromatic base material 20 in the axial direction of the cover 10 when the electric heating means of the inhalation implement is inserted in one or both axial-direction end surfaces of the cover 10, preferably in the end surface positioned on the aromatic-base-material 20 side. Examples of the shape with which it is possible to restrict movement of the aromatic base material 20 in the axial direction of the cover 10 include shapes with which movement of the material in the aromatic base material 20 can be restricted to the extent that it does not impede practical use.

Due to the support member 40 being formed in this manner, when the electric heating means for heating the aromatic base material 20 in the heated smoking implement is inserted from the one-end side of the aromatic cartridge 100, the support member 40 restricts movement of the aromatic base material 20 toward the other-end side. Specifically, the support member 40 can support the aromatic base material 20.

Additionally, when the aromatic-component-containing aerosol generated from the aromatic base material 20 passes through the support member 40, the support member 40 can cool the high-temperature aerosol. For this reason, the support member 40 is formed from a material having a level of heat resistance that corresponds to the combustion temperature or heating temperature of the aromatic cartridge 100. For example, when the aromatic cartridge 100 is used in a heated smoking implement, the support member is preferably formed using a member having heat resistance at about 200-350° C.

Examples of such a member include members made of paper, resin, rubber, wood, metal, and ceramics; however, it is preferable to use resin, which can be molded into a variety of shapes.

The resin may be any thermoplastic or thermosetting resin. Examples of the resin include polyolefin resins, polyester resins, polystyrene resins, nylon resins, acrylic resins, silicone resins, fluorine resins, polyurethane resins, ethylene-vinyl acetate (EVA) resins, phenol resins, amino resins, ABS resins, and biodegradable plastics. Among these, biodegradable plastics are preferred from the standpoint of protecting the natural environment because the aromatic cartridge 100 is a waste product after use.

Examples of biodegradable plastics include poly(3-hydroxybutyrate) (PHB), poly(ε-caprolactone) (PCL), poly (butylene succinate) (PBS), and polylactic acid (PLA).

The aromatic base material 20 of the aromatic cartridge 100 is heated, by the electric heating means of the inhalation implement (not shown), from either room temperature or the outside air temperature to a heating target temperature equal to or greater than 200° C. Therefore, the aromatic base material 20 is subjected to a process for raising the temperature from either room temperature or the outside air temperature to the heating target temperature. A user can inhale the aerosol emanating from the aromatic cartridge 100 immediately after completion of the temperature-raising process.

(Configuration of Aromatic Base Material 20)

The aromatic base material 20 includes a pulverized and dried plant matter that generates an aroma through being heated, an aerosol former that generates an aerosol through being heated, and a cannabinoid-containing substance. Therefore, the aromatic base material 20 can generate an aromatic-component-containing aerosol through being heated. The aromatic base material 20 preferably contains at least one from among heat-meltable substances that melt through being heated, catechins, crosslinked polyvinyl pyrrolidone pulverized and dried polyvinyl pyrrolidone, and perfumes.

The aromatic base material 20 may also include other substances, such as aromatic agents that can augment the aroma emanating from the pulverized and dried plant matter, molding agents that can improve the moldability of the aromatic base material 20, binders that contribute to binding and integration of the aerosol former and the pulverized and dried plant matter, sorbents that can cause the aromatic agents to temporarily reside in the aromatic base material 20, and preservatives that can improve the preservability of the aromatic base material 20.

As shown in FIG. 4, the aromatic base material 20 is formed of a two-layer structure configured from a first base material 21, which does not include the cannabinoid-containing substance, and a second base material 22, which does include the cannabinoid-containing substance. In this configuration, the first base material 21 is positioned on the distal-end side, and the second base material 22 is positioned on the proximal-end side. The second base material 22 can be formed through, e.g., impregnation with a liquid cannabinoid-containing substance.

The positioning of the first base material 21 and the second base material 22 is not limited to the example described above; for example, the second base material 22 may be disposed on the distal-end side, and the first base material 21 may be positioned on the proximal-end side. Additionally, a plurality of first base materials 21 and second base materials 22 may be disposed. For example, the first base materials 21 and second base materials 22 may be disposed in an alternating manner along the axial direction of the aromatic cartridge 100.

(Pulverized and Dried Plant Matter)

Examples of the pulverized and dried plant matter include not only tobacco leaves and stems but also leaves, stems, flowers, seeds, fruits, bark, and roots of non-tobacco plants.

In particular, including at least one or more selected from among: flowers of Chinese tea, black tea, roses, *Oleaceae Osmanthus fragrans* plants, lavender, and saffron; rhizomes of Japanese leek, shallot, garlic, onion, and konjac; fruits of quince, *Rutaceae Citrus* plants (such as *C. aurantiurn, C unshiu, C. natsudaidai, C. r.* var. *poonensis, C. hassaku, C. iyo, C. wilsonii, C. trifoliata, C. sinensis, C. reticulata, C. sphaerocarpa, C. kinokuni, C. myrtifolia, Citrus paradisi, C. leiocarpa, C. sulcata, C. medica, C. jabara, C. sudachi, C. tachibana, C. reticulate sinensis, Natsumikan, C. hanayu, C. tamurana, C. depressa* (Okinawa lime), *C. maxima* (pomelo), *C. junos, C. aurantifolia, C. limon*, and *C. hystrix*), *Rosaceae Prunus persica* plants, apple, pineapple, mango, kumquat, melon, pomegranate, Japanese plum, apricot, blueberry, *Rosaceae* Fragraria plants, raspberry, banana, and grape; and terrestrial stems and leaves of Lamiaceae *Mentha* peppermint plants (such as *Mentha piperita, M. c.* var. *piperascens, M. suaveolens, M. aquatica, M. requienii*, and *M. pulegium*), Lamiaceae *Mentha* spearmint plants (such as spearmint, *M. longifolia, M. spicata, M. spicata* var. *crispa*, and *Mentha* gracilis), catnip, lemon balm, summer savory, hyssop, and Solanaceae *Nicotiana tabacum* plants, in the pulverized and dried plant matter is suitable for providing a pleasant aroma to the user. However, the pulverized and dried plant matter is not limited to these ingredients.

The pulverized and dried plant matter is preferably provided with three elements in combination, specifically: fragrance, which is defined as a scent wafting from the aroma cartridge 100; aroma, which is defined as a scent wafting in a space when the aromatic cartridge 100 is heated; and flavor, which is defined as a scent wafting into the mouth upon inhalation together with the aerosol when the aromatic cartridge 100 is heated.

It is preferable to include, as the pulverized and dried plant matter constituting the fragrance (also referred to below as fragrance component), at least one or more selected from among: flowers of Chinese tea, black tea, roses, *Oleaceae Osmanthus fragrans* plants, lavender, and saffron; and terrestrial stems and leaves of Solanaceae *Nicotiana tabacum* plants.

It is preferable to include, as the pulverized and dried plant matter constituting the aroma (also referred to below as aroma component), at least one or more selected from among: rhizomes of Japanese leek, shallot, garlic, onion, and konjac; and terrestrial stems and leaves of Solanaceae *Nicotiana tabacum* plants.

It is preferable to include, as the pulverized and dried plant matter constituting the flavor (also referred to below as flavor component), at least one or more selected from among: fruits of quince, *Rutaceae Citrus* plants (such as *C. aurantium, C. unshiu, C. natsudaidai, C. r.* var. *poonensis, C. hassaku, C. iyo, C. wilsonii, C. trifoliata, C. sinensis, C reticulata, C. sphaerocarpa, C. kinokuni, C. myrtifolia, Citrus paradisi, C. leiocarpa, C. sulcata, C. medica, C. jabara, C. sudachi, C. tachibana, C. reticulata sinensis, Natsumikan, C. hanayu, C. tamurana, C. depressa* (Okinawa lime), *C. maxima* (pomelo), *C. junos, C. aurantifolia, C. limon*, and *C. hystrix*), *Rosaceae Prunus persica* plants, apple, pineapple, mango, kumquat, melon, pomegranate, Japanese plum, apricot, blueberry, *Rosaceae* Fragraria plants, raspberry, banana, and grape; and terrestrial stems and leaves of Lamiaceae *Mentha* peppermint plants (such as *Mentha piperita, c.* var. *piperascens, suaveolens, M. aquatica, M. requienii*, and *M. pulegium*), Lamiaceae *Mentha* spearmint plants (such as spearmint, *M. longifolia, M. spicata, M. spicata* var. *crispa*, and *Mentha* gracilis), catnip, lemon balm, summer savory, hyssop, and Solanaceae *Nicotiana tabacum* plants.

(Aerosol Former)

The aerosol former is added in order to generate an aerosol when the aromatic base material 20 is heated. Examples of materials that can be used as the aerosol former include glycerin, propylene glycol, sorbitol, triethylene glycol, lactic acid, diacetin (glyceryl diacetate), triacetin (glyceryl triacetate), triethylene glycol diacetate, triethyl citrate, isopropyl myristate, methyl stearate, dimethyl dodecanedioate, and dimethyl tetradecanedioate. Among these, glycerin and propylene glycol are particularly preferable for use.

(Cannabinoid-Containing Substance)

Cannabinoids are compounds activated by cannabinoid receptors within the human body, these compounds serving to induce many medicinal actions of *cannabis*. Plant-derived cannabinoids, also known as plant-based cannabinoids, are abundant in *cannabis*.

The cannabinoid-containing substance may be an extract that is extracted from *cannabis* or the like and that contains a cannabinoid in a comparatively high concentration, or may be a further-refined cannabinoid. Synthesized cannabinoids, or semi-synthesized cannabinoids in which the extracted substance is subjected to an additional reaction, may also be used.

A wide variety of cannabinoids are known, such as cannabidiol (CBD), cannabinol (CBN), cannabichromene (CBC), cannabielsoin (CBE), cannabigerol (CBG), cannabidivarin (CBDV), and tetrahydrocannabinol (THC).

However, when the cannabinoid-containing substance contains tetrahydrocannabinol (THC), there will be legal restrictions depending on the country, and phenomena/symptoms/effects that cannot be said to be the desired awakening effect or calming effect might occur. Therefore, the aromatic cartridge 100 according to the present invention preferably does not contain any tetrahydrocannabinol (THC).

The cannabinoid can be extracted from *cannabis* (hemp), but because a substance extracted from *cannabis* leaves or flowers will contain tetrahydrocannabinol (THC), it is preferable to employ a substance extracted from *cannabis* stems or seeds, which do not contain THC, and it is particularly preferable to employ a substance extracted from aged *cannabis* stems or seeds.

The aromatic cartridge 100 according to the present invention preferably contains at least one cannabinoid selected from the group consisting of cannabidiol (CBD), cannabinol (CBN), cannabichromene (CBC), cannabielsoin (CBE), cannabigerol (CBG), cannabidivarin (CBDV), and particularly preferably contains CBD.

(CBD)

Medical effects have been reported with cannabidiol (CBD), examples including anxiolytic effects, antiepileptic effects, nerve protection, vasorelaxation, anticonvulsant effects, anti-ischemic effects, anticancer effects, antiemetic effects, antibacterial effects, antidiabetic effects, anti-inflammatory effects, and promotion of bone growth.

The present invention preferably contains at least 80 mass %, more preferably at least 90 mass %, and particularly preferably at least 97 mass % of cannabidiol (CBD) relative to the entire amount of cannabinoid. It is most preferable to incorporate crystals of CBD extracted from *cannabis* stems or seeds.

The cannabinoid-containing substance is preferably contained dissolved in a solvent selected from oils and fats such as olive oil or coconut oil, and alcohol-based solvents such as glycerin and glycol.

The cannabinoid-containing substance can also be incorporated dissolved in, inter alia, the heat-meltable substance that shall be described below.

(Heat-Meltable Substance)

The heat-meltable substance dissolves at a comparatively low temperature and is added in order to make it easier for the aromatic component generated from the aromatic base material 20 to be dissolved, vaporized, and emitted together with the aerosol former. The heat-meltable substance also serves to secure an aromatic raw material pulverized and dried the aromatic agent in place at normal temperature.

The melting point of the heat-meltable substance is within the range of 50-100° C., preferably 50-80° C., and more preferably 60-67° C. When the melting point of the heat-meltable substance is below 50° C., the heat-meltable substance will dissolve in the summertime or other periods when the air temperature is high, and there will be a risk of the aromatic cartridge becoming sticky. Conversely, when the melting point of the heat-meltable substance exceeds 100° C., the heat-meltable substance will not readily dissolve in an initial step of the process for raising the temperature of the aromatic base material, and the aroma of the aerosol immediately after completion of the temperature-raising process by the heated smoking implement will tend to be insufficient.

The melting point of the heat-meltable substance can be measured in conformance with, for example, the method for measuring the melting point of paraffin wax stipulated in JIS K2235. Specifically, using prescribed a melting point tester, a molten specimen can be introduced into a test tube, a reading can be taken from a thermometer for measuring melting point every 15 seconds, and the temperature when the reduction in temperature is within a fixed range (when the difference has been within 0.1° C. for five instances) can be measured as the melting point.

The heat-meltable substance is preferably in the form of a powder. The average grain diameter of the heat-meltable substance is preferably 125-355 μm, more preferably 150-300 μm, and even more preferably 180-250 μm. The average grain diameter can be measured by using, e.g., a laser-diffraction device for measuring grain size distribution. The average grain diameter in the present invention refers to the median diameter.

When the average grain diameter of the heat-meltable substance is excessively high, the total surface area thereof will decrease, and the opportunity for contact with a heat source will also decrease. As a result, the heat-meltable substance will not sufficiently dissolve, and the aromatic-component concentration of the aerosol immediately after completion of the temperature-raising process will tend to decrease.

When the average grain diameter of the heat-meltable substance is excessively low, it will be difficult to form a sea-island structure in which the heat-meltable substance is dispersed in the aromatic base material 20, the sea-island structure being described later. As a result, the heat-meltable substance will agglomerate and be present in the aromatic base material 20 in the form of massive deposits, enabling formation of a region where the speed of melting through contact with the heat source decreases and resulting in a tendency for the aromatic-component concentration of the aerosol immediately after completion of the temperature-raising process to decrease. The amount of the heat-meltable substance contained in the aromatic base material 20 is 2-20 mass %, preferably 3-15 mass %, and more preferably 5-15 mass %.

The blending amounts of the aromatic raw material, the aerosol former, and the heat-meltable substance are preferably 55-75 mass %, 20-40 mass %, and 2-15 mass %, respectively, and more preferably 60-70 mass %, 25-35 mass %, and 3-10 mass %, respectively, in order to achieve balance between the volatilization amounts of a smoke component and the aromatic component.

There is no particular limitation as to the heat-meltable substance, provided that the heat-meltable substance is "an organic compound that exhibits melting and softening points through being heated and that is a non-Newtonian fluid." Organic compounds typically referred to as waxes are preferred as the heat-meltable substance, it being possible to use petroleum-based natural waxes, synthetic waxes, plant-based natural waxes, and animal-based natural waxes that are model examples of waxes. It is also possible to use a variety of tackifiers (adhesion-imparting agents), including rosins, that are also used as waxes. These waxes can be used alone or in a mixture containing at least one or more selected from among these waxes.

It is preferable to use a plant-based natural wax or animal-based natural wax as the heat-meltable substance, from the standpoint of having a desired melting point and imparting flavor. Examples of materials that can be used as plant-based natural waxes include sumac wax, lacquer wax, carnauba wax, sugarcane wax, palm wax, and candelilla wax. Examples of materials that can be used as animal-based natural waxes include beeswax, spermaceti, insect wax, wool wax, and shellac. These waxes make it easier to obtain the substance having a melting point within the range of 50-100° C. that may be stipulated by the present invention and have desirable flavors in their own right, therefore making it possible to enhance the aroma of the aerosol. Among these natural waxes, carnauba wax, beeswax, petroleum jelly, and paraffin waxes are particularly preferred, and beeswax, which has an abundance of the aromatic component and has a melting point of 62-65° C., is most preferred.

The plant-based natural waxes and animal-based natural waxes have esters of fatty acids and aliphatic alcohols as main ingredients. The plant-based natural waxes and animal-based natural waxes are mixtures of esters of fatty acids and aliphatic alcohols having various numbers of carbon atoms, and also include free fatty acids and free aliphatic alcohols or hydrocarbons. Therefore, the plant-based natural waxes and animal-based natural waxes are characterized by having a broad distribution of molecular weight, a broad temperature zone for melting points, and high viscosity during melting.

Petroleum-based natural waxes, due to being hydrocarbon compounds, have an advantage in that there is little interaction between the aromatic component and the aerosol former and little likelihood of adversely affecting the flavor. Petroleum jelly, paraffin waxes, microcrystalline waxes, and the like can be used on a preferred basis as petroleum-based natural waxes.

These petroleum-based natural waxes differ in terms of the temperature zone for melting points based on molecular structure. Petroleum jelly is a mixture of a branched hydrocarbon and an alicyclic hydrocarbon and has a broad temperature zone for melting points, i.e., 36-60° C.

Paraffin waxes have a straight-chain hydrocarbon as a main ingredient and have high crystallinity, and the large majority thereof exhibit a melting point of 40-70° C., this being a narrow temperature zone for melting points.

Microcrystalline waxes are mixtures of a branched hydrocarbon and a saturated cyclic hydrocarbon and have low crystallinity but high molecular weight, and moreover exhibit a melting point of 60-90° C., which is the highest among these types of waxes, this temperature zone for melting points being even next broadest to that of petroleum jelly.

All of these petroleum-based natural waxes are hydrocarbon compounds extracted from crude oil. Paraffin waxes and microcrystalline waxes have low melt viscosity during melting with heat and low surface energy and exhibit little interaction between the aromatic component and the aerosol former.

It is preferable to use, e.g., any of Paraffin Wax-115, 120, 125, 130, 135, 140, 145, 150, or 155, which are standard products made by Nippon Seiro KK, as a paraffin wax. It is also preferable to use particular paraffin waxes, such as: HNP-based products that are high-purity refined paraffin waxes, which are custom-made products of Nippon Seiro KK; SP-based products designed for specific uses; and EMW-based products having, as a main ingredient, isoparaffin manufactured through particular manufacturing methods. In addition, it is preferable to use, e.g., any waxes in the Hi-Mic series made by Nippon Seiro KK as a microcrystalline wax.

Fischer-Tropsch waxes, polyethylene (PE) waxes, modified PE waxes, polypropylene (PP) waxes, modified PP waxes, fatty acid amides, fatty acids, aliphatic alcohols, polyoxyalkylene glycols, polyoxyethylene alkyl ethers, polyoxyethylene alkyl amines, and the like can be used on a preferred basis as synthetic waxes.

In particular, Fischer-Tropsch waxes, due to being straight-chain-hydrocarbon-based organic compounds, have low melt viscosity during melting with heat and low surface energy and exhibit little interaction between the aerosol former and the aromatic component. Medium-melting-point products C80, etc. (melting point: about 85-88° C.), and the like can be used as Fischer-Tropsch waxes.

PE waxes, modified PE waxes, PP waxes, and modified PP waxes are also hydrocarbon compounds and can also be used on a preferred basis. Specifically: "High wax (registered trademark)" made by Mitsui Chemicals, Inc.; "Sunwax," "Biscol," and the like made by Sanyo Chemical industries, Ltd.; and "CERAFAK (registered trademark) 929, 950, 913, 914, 915," and the like made by BYK can be used on a preferred basis.

In particular, metallocene-catalyzed polyolefin waxes have a narrow distribution of molecular weight and are more desirable. For example, "EXELLEX (registered trademark)" made by Mitsui Chemicals, Inc., which is a metallocene-catalyzed PE wax, has a narrow distribution of molecular weight and a narrow distribution of compositions, and therefore has a melting point of 89-128° C., but also has a low melt viscosity during melting with heat and is especially exceptional as the polyolefin wax.

In addition to the above, it is also possible to use fatty acid amides, fatty acids, aliphatic alcohols, and the like as the heat-meltable substance. Monoamides and bisamides are suitable as fatty acid amides. Stearic acid monoamide, oleic acid monoamide, and erucic acid monoamide have melting points of about 72-105° C. and are preferred as monoamides.

In addition to the cannabinoid-containing substance, it is also possible to incorporate: physiologically active substances such as catechins, caffeine, and theanine; refreshing agents such as menthol; flavor components such as coffee extract; perfumes; and the like into the aromatic cartridge 100 according to the present invention.

(Catechin)

Epicatechin, catechin, epigallocatechin, epicatechin gallate, catechin gallate, epigallocatechin gallate, and gallocatechin gallate are preferably included as catechins. Among these, epicatechin and epigallocatechin are preferably included. In the present invention, it is also possible to use catechins obtained by refining the aforementioned catechins to a high purity, and it is moreover possible to use extracts extracted from catechin-containing plants using a suitable solvent, or to use coarsely refined products that are coarsely refined form the extracts such that the catechin content increases.

It is possible to use, e.g., tea leaves selected from green tea, roasted green tea, kabuse tea, gvokuro, or the like as the catechin-containing plant. Catechins can be obtained through extraction from the tea leaves using water, an alcohol such as ethanol or methanol, acetone, or another solvent, and furthermore through fractionation if necessary. For example, an extract obtained through extraction from the tea leaves using hot water can be fractionated using an organic solvent such as ethyl acetate and then dried, thereby yielding a powder containing 30-98 mass % of catechins such as epigallocatechin gallate, gallocatechin gallate, epicatechin gallate, catechin gallate, epigallocatechin, gallocatechin, epicatechin, and (+) catechin.

The catechin-containing powder preferably contains catechins in an amount of at least 0.03 mass %, more preferably 0.1-5 mass %, and even more preferably 1-4 mass %. Catechin powders containing high concentrations of catechins are commercially available from a variety of sources, and these commercially available products can be used as well.

The catechin content can be quantified using methods such as the ferrous tartarate method (Tea Research Journal 71(1990), pp. 43-74) or high-performance liquid chromatography (HPLC).

(Caffeine)

Caffeine is the most characteristic component of coffee and is also widely contained in food products such as teas, cocoa, and colas. Well-known effects of caffeine include stimulant actions such as suppressing drowsiness, and diuretic actions for prompting discharge of urine; a variety of other effects such as "enhancing the working of autonomic nerves," "enhancing concentration and improving work performance," and "improving exercise performance" are also being clarified. Including caffeine makes it possible to imbue a feeling of relief, suppress drowsiness, and imparting fever-reducing and painkilling actions to the user in a user who inhales the aerosol.

The caffeine is preferably included in an amount of 1-50 mg, more preferably 5-30 mg, and even more preferably 10-20 mg per aromatic cartridge 100. The caffeine can also be added as a component contained in a coffee extract serving as a flavor component that shall be described later.

(Theanine)

Theanine can be incorporated into the aromatic base material 20 using, e.g., not only extracts obtained through extraction from tea leaves using hot water but also green tea leaf powders, green tea leaf extracts, green tea leaf perfumes, and the like. Including theanine in the aromatic base material 20 makes it possible to suppress the working of sympathetic nerves in a user who inhales the aerosol, inducing relaxation.

The theanine is included in the aromatic base material 20 of a single aromatic cartridge 100 in an amount of 10-100 mg, preferably 20-80 mg, and even more preferably 30-60 mg in order to achieve a relaxing effect in a user who has a low tendency to be anxious. Moreover, the theanine is included in an amount of 20-120 mg, preferably 30-100 mg, and even more preferably 40-80 mg in order to achieve the relaxing effect in a user who has a high tendency to be anxious.

In addition, the theanine is included in an amount of 3.3-33 mass %, preferably 6.6-26 mass %, and even more preferably 10-24 mass % relative to the aromatic base material 20 in order to achieve a relaxing effect in a user who has a low tendency to be anxious. Moreover, the theanine is included in an amount of 6.6-10 mass %, preferably 10-33.3 mass %, and even more preferably 13.3-26.6 mass % relative to the aromatic base material 20 in order to achieve a relaxing effect in a user who has a high tendency to be anxious. When theanine is contained in an amount of at least 100 mass % relative to the aromatic base material 20, the theanine is preferably, e.g., sealed in the capsule described above and incorporated in the aromatic cartridge 100.

(Refreshing Agent)

Examples of substances that can be used as the refreshing agent include menthol, menthol derivatives, menthone, menthone derivatives, menthane carboxamide, 2,3-dimethyl-2-(2-propyl)-butyric acid derivatives, menthane, menthane derivatives, L-carvone, xylitol, essential *eucalyptus* oil, mint oil, essential spearmint oil, and spilanthol.

(Component Extracted from Coffee)

The component extracted from coffee preferably includes, e.g., caffeine, pyridine, methylpyrazine, acetic acid, furfuryl alcohol, cyclotene, 1H-pyrrole carbon aldehyde, hydroxypyridine, hydroxyacetone, furfural, methyl furfural, maltol, and other coffee flavor components.

Examples of substances that can be used as the component extracted from coffee include coffee bean powders, coffee extracts, coffee perfumes, and raw coffee extracts.

The component extracted from coffee is included in the aromatic base material 20 of a single aromatic cartridge 100 in an amount of 0.3-60 mg, preferably 1.5-30 mg, and even more preferably 3-15 mg.

The component extracted from coffee is included in an amount of 0.1-20 mass %, preferably 0.5-10 mass %, and even more preferably 1-5 mass % relative to the aromatic base material 20.

(Perfume)

Any natural perfumes, synthetic perfumes, or compounded perfumes can be used as the perfume. The perfume can be used as both flavor (food product additive) and fragrance (cosmetic product perfume).

Examples of the type of scent in the perfume include *citrus*, floral, fruity, milk, chypre, Oriental, food-like (as desired), ready-made smoking-implement-type (as desired), vanilla, minty, sweet, spicy, nutty, and alcohol-like scents.

Among these, it is preferable to employ: perfumes having *citrus*, fruity, minty, and other scents to evoke a refreshing feel; perfumes having food-like scents (as desired) such as chocolate, milk, and coffee, and other scents to evoke relaxation; and perfumes having vanilla, floral, sweet, and other scents to evoke sweetness.

(Sorbent)

In the present invention, a sorbent is preferably used in order to prevent volatilization of the refreshing agent or perfume before the temperature of the aromatic base material 20 reaches an optimal temperature at which the aerosol former and the aromatic raw material volatilize. As indicated above, the sorbent can cause the refreshing agent, perfume, or other aromatic agents to temporarily reside in the aroma-generating material 20 to be heated.

As one preferred aspect of the sorbent, it is possible to use a sorbent that adsorbs the aforementioned compounds to thereby cause the compounds to temporarily reside in the aroma-generating base material 20. For example, when the compound is menthol, the menthol has phenolic hydroxyl groups. Therefore, it is possible to use, e.g., crosslinked polyvinylpyrrolidone (polyvinylpolypyrrolidone (PVPP)), polyvinylpyrrolidone (PVP), or another hydrophilic crosslinked polymer capable of adsorbing the phenolic hydroxyl groups, as the sorbent.

Additionally, for example, when the compound is nicotine, the nicotine has nitrogen-containing five-membered heterocyclic compounds. Therefore, it is possible to use crosslinked PVP, with which nitrogen-containing five-membered heterocyclic compounds are thought to interact, as the sorbent.

When crosslinked PVP pulverized and/or dried PVP is used as the sorbent, the sorbent is incorporated in an amount of 4-25 mass %, and more preferably 5-20 mass %, per 100 mass % of the total quantity of the aromatic raw material, the aerosol former, and the heat-meltable substance.

It is also possible to use a sorbent that makes subsumption of the aforementioned compounds to thereby cause the compounds to temporarily reside in the aroma-generating base material 20. Cyclodextrins can be used as such sorbents.

Cyclodextrins are known to create clathrate compounds with chemical substances that have hydroxyl groups or carboxyl groups of various sizes. Any of α-, β-, and γ-cyclodextrin can be used. In particular, β-cyclodextrin forms clathrate compounds with menthol and is optimal as a sorbent for menthol.

When a cyclodextrin is used as the sorbent, the sorbent is contained in an amount of 0.1-1.2 mass %, and more preferably 0.2-1.0 mass %, per 100 mass % of the total quantity of the aromatic raw material, the aerosol former, and the heat-meltable substance.

The sorbent also serves to retain the cannabinoid-containing substance, as well as physiologically active substances such as catechins, caffeine, and theanine, via adsorption.

It is even more preferable to include both PVPP and a cyclodextrin as sorbents.

(Molding Agent)

The molding agent is used in order to reinforce the physical strength of the aromatic base material 20. Examples of substances that can be used as the molding agent include cellulose fiber and microcrystalline cellulose.

It is preferable to use cellulose fiber from, e.g., sugarcane, bamboo, barley, rice, esparto, jute, *cannabis*, wood, or the like as the cellulose fiber. The fiber diameter of these cellulose fibers is preferably 5-25 μm, and the fiber length of the cellulose fibers is preferably 0.25-6 mm. Using cellulose fiber having a fiber diameter and fiber length within these ranges makes it possible to enhance the effect for unifying the constituent components of the aromatic base material 20.

The microcrystalline cellulose preferably has an average grain diameter of 70-120 μm. When the average grain diameter of the microcrystalline cellulose is less than 70 μm, it will tend to be difficult to suppress shrinkage of the aromatic base material 20 and to prevent conglutination of the aromatic base material 20 and a molding machine. Conversely, when the average grain diameter of the microcrystalline cellulose exceeds 120 μm, the aromatic base material 20 will tend to readily break. The average grain diameter of the microcrystalline cellulose can be measured by using a laser-diffraction device for measuring grain size distribution. The average grain diameter in the present invention refers to the median diameter.

The weight-average molecular weight (Mw) of the microcrystalline cellulose is preferably 20,000-60,000. When the weight-average molecular weight (Mw) of the microcrystalline cellulose is less than 20,000, the effect for suppressing shrinkage of the aromatic base material 20 will tend to be scarce. Conversely, when the weight-average molecular weight (Mw) of the microcrystalline cellulose exceeds 60,000, the aromatic base material 20 will tend to readily break.

The molding agent is preferably contained in an amount of 2-25 mass %, preferably 3-20 mass %, per 100 mass % of the total quantity of the aromatic raw material, the aerosol former, and the heat-meltable substance. Incorporating the molding agent in the aromatic base material 20 in the aspect described above makes it possible to fulfill the aforementioned functions and prevent the molding agent from adversely affecting generation of volatile substances in the aromatic raw material and the aerosol former.

(Binder)

The binder is used in order to bind the aromatic raw material, the aerosol former, the heat-meltable substance, and other raw materials constituting the aromatic base material. Examples of substances that can be used as the binder include polysaccharide polymers, cellulose polymers, and calcium carbonate.

It is possible to use, e.g., konjac mannan (glucomannan), guar gum, pectin, carrageenan, tamarind seed gum, gum Arabic, soybean polysaccharides, locust bean gum, karaya gum, xanthan gum, and agar-agar as the polysaccharide polymer. From the standpoint of strength and molding properties, glucomannan, guar gum, pectin, carrageenan, tamarind seed gum, locust bean gum, karaya gum, and xanthan gum are preferred as the polysaccharide polymer, and the neutral polysaccharides glucomannan, guar gum, tamarind seed gum, and locust bean gum are more desirable.

It is possible to use, e.g., carboxymethyl cellulose (CMC), carboxyethyl cellulose, hydroxymethyl cellulose, hydroxyethyl cellulose, hydroxypropyl cellulose, sodium salts of CMC, potassium salts of CMC, calcium salts of CMC, sodium salts of carboxyethyl cellulose, potassium salts of carboxyethyl cellulose, and calcium salts of carboxyethyl cellulose as the cellulose polymer. From the standpoint of the strength and molding properties of the aromatic base material 20, sodium salts of CMC, potassium salts of CMC, sodium salts of carboxyethyl cellulose, and potassium salts of carboxyethyl cellulose are preferred as the cellulose polymer.

It is preferable to use a polysaccharide polymer and a cellulose polymer in combination as the binder. In such a case, glucomannan, guar gum, tamarind seed gum, and locust bean gum are preferred as the polysaccharide polymer, and sodium salts of CMC, potassium salts of CMC, sodium salts of carboxyethyl cellulose, and potassium salts of carboxyethyl cellulose are preferred as the cellulose polymer. Thus, using a polysaccharide polymer and a cellulose polymer in combination makes it possible to improve the strength and molding properties of the aromatic base material 20.

The binder is preferably contained in an amount of 5-30 mass %, and more preferably 8-28 mass %, per 100 mass % of the total quantity of the aromatic raw material, the aerosol former, and the heat-meltable substance. Incorporating the binder in the aromatic base material 20 in such an amount makes it possible to improve the strength and molding properties of the aromatic base material 20 and makes it possible to avoid adversely affecting, inter alia, the generation of volatile substances in the aromatic raw material and the aerosol former.

The aromatic base material 20 according to the present invention preferably contains both a binder and a molding agent. In such a case, the blending ratio of the binder and the molding agent is preferably 1:1-1:25 from the standpoint of the unification effect.

(Preservative)

A preservative is preferably used in order to preserve the aroma-generating cartridge to be heated in the long term. Examples of substances that can be used as the preservative include potassium sorbate pulverized and dried sodium benzoate. The preservative is preferably included in an amount of 0.005-0.04 mass % per 100 mass % of the total quantity of the aromatic raw material, the aerosol former, and the heat-meltable substance.

Figure 5:
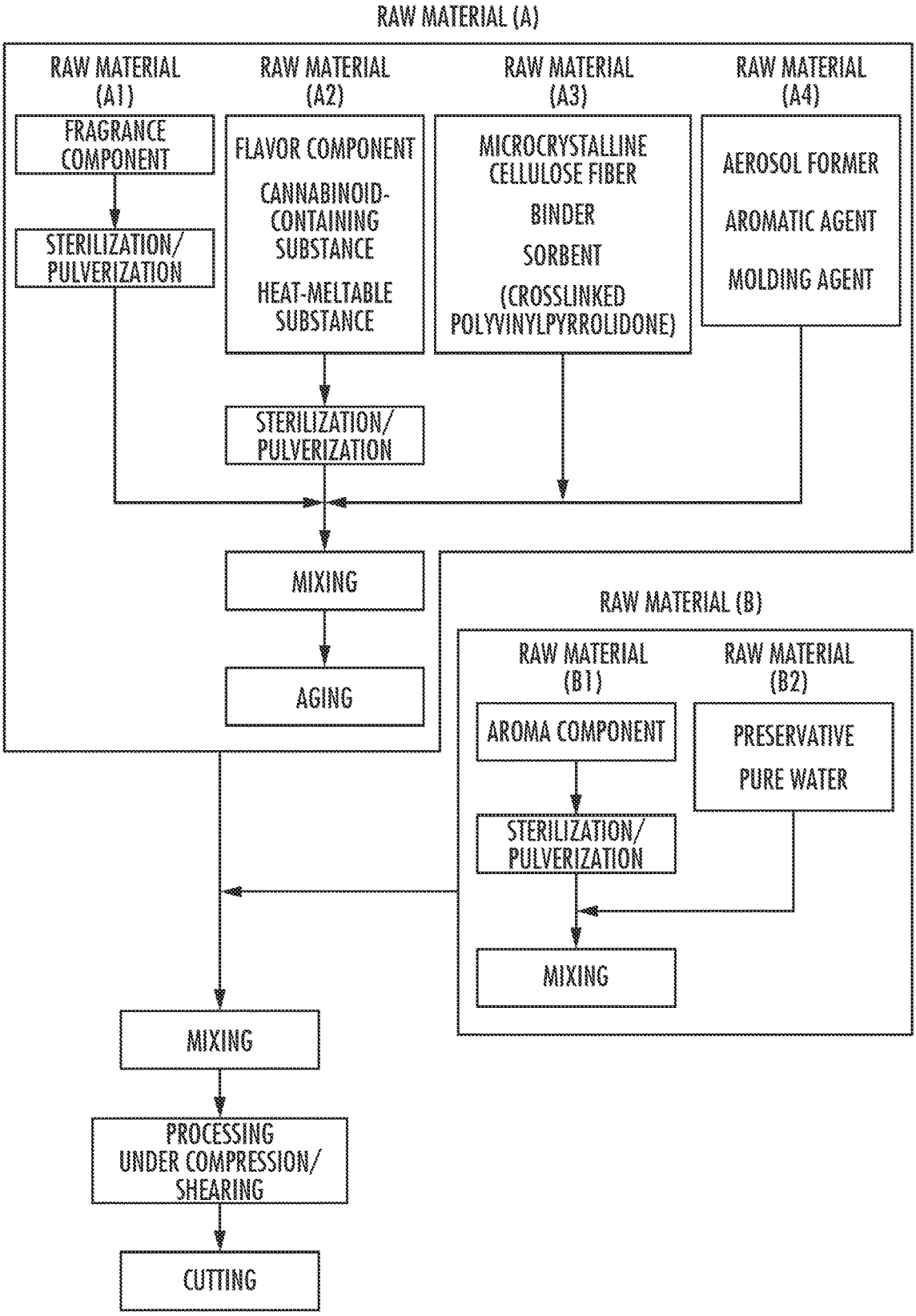
FIG. 5 is a flow chart showing steps for manufacturing the aromatic base material in FIG. 1.

Next, the method for manufacturing the second base material 22 of the aromatic base material 20 shall be described. FIG. 5 shows one embodiment of steps for manufacturing the second base material 22 of the aromatic base material 20. As shown in FIG. 5, a mixing step is carried out to mix together: a raw material (A) containing the fragrance component that is the pulverized and dried plant matter constituting the fragrance, the flavor component that is the pulverized and dried plant matter constituting the flavor, and the like; and a raw material (B) containing the aroma component that is the pulverized and dried plant matter constituting the aroma, and the like. The mixing step is carried out at a temperature below the melting point of the heat-meltable substance. The mixing step can be carried out using, e.g., a well-known mixer.

The raw material (A) is obtained by mixing and aging: a raw material (A1) that contains the fragrance component that is the pulverized and dried plant matter constituting the fragrance; a raw material (A2) that contains the flavor component that is the pulverized and dried plant matter constituting the flavor, the cannabinoid-containing substance, and the heat-meltable substance; a raw material (A3) that contains an alcohol aqueous solution of the microcrystalline cellulose, an alcohol aqueous solution of the binder, and an alcohol aqueous solution of the sorbent; and a raw material (A4) that contains the aerosol former, the aromatic agent, and the molding agent.

The raw materials (A1) to (A4) are mixed at a temperature below the melting point of the heat-meltable substance. This mixing step can be carried out using, e.g., a well-known mixer.

The raw material (A1) is obtained by sterilizing and then pulverizing the fragrance component.

Figure 6:
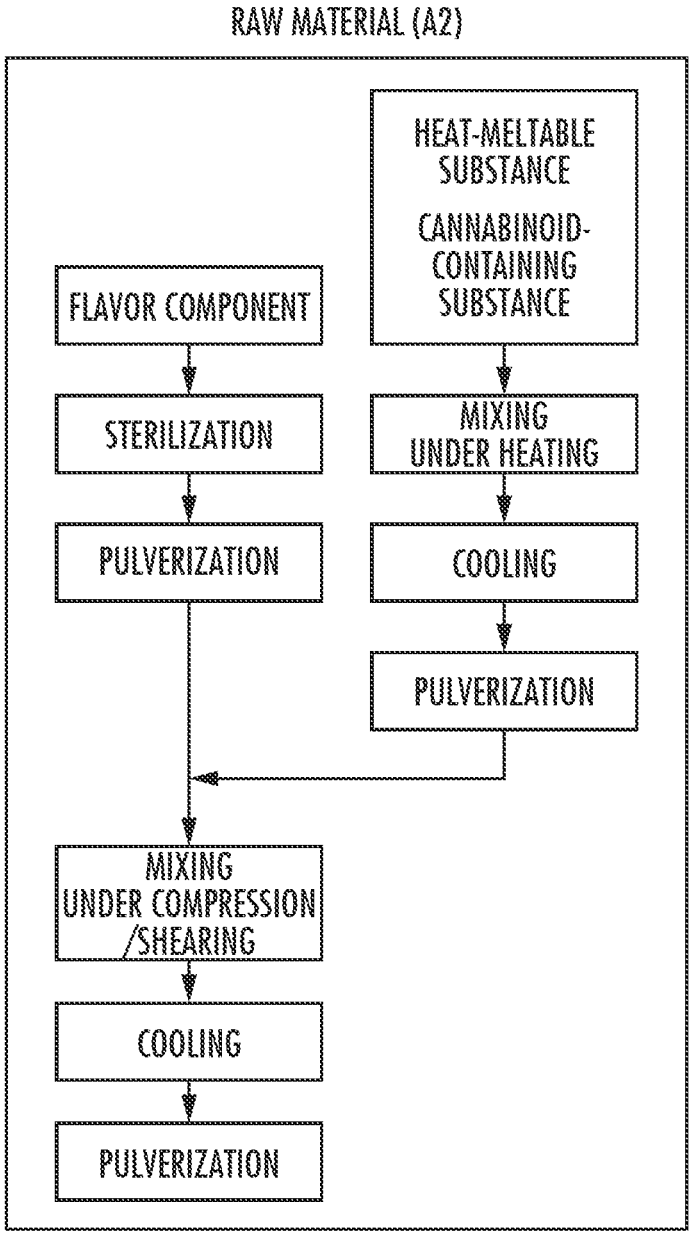
FIG. 6 is a flow chart showing the step for manufacturing a raw material (A2) in FIG. 5.

The raw material (A2) is obtained by sterilizing and then pulverizing a mixture of the flavor component, the cannabinoid-containing substance, and the heat-meltable substance. Specifically, as shown in FIG. 6, the flavor component is sterilized and then pulverized so as to reach a prescribed size. The powder-form heat-meltable substance and the cannabinoid-containing substance are heated under mixing at a temperature equal to or greater than the melting point of the heat-meltable substance, cooled, and then pulverized so as to reach a prescribed size. The resulting pulverized matter and the powder-form flavor component are preferably mixed under compression/shearing, cooled, and then pulverized to create the raw material (A2).

The raw material (A3) is obtained by mixing the alcohol aqueous solution of the microcrystalline cellulose, the alcohol aqueous solution of the binder, and the alcohol aqueous solution of the sorbent (crosslinked polyvinylpyrrolidone and/or polyvinylpyrrolidone). The alcohol aqueous solutions are liquid mixtures of pure water and ethanol.

The raw material (A4) is obtained by mixing the aerosol former, the aromatic agent, and the molding agent.

Aging is, for example, preferably carried out for 3-14 days under a temperature of 15-30° C. It is more preferable to carry out aging for 4-7 days under a temperature of 20±2° C. from the standpoint of retaining the aromatic component. When the temperature exceeds 30° C., or when the aging period exceeds 14 days, the possibility of decomposition or mold production will tend to increase.

The raw material (B) is obtained by mixing a raw material (B1) containing the aroma component that is the pulverized and dried plant matter constituting the aroma, and a raw material (B2) containing the preservative. The raw materials (B1) and (B2) can be mixed using, e.g., a well-known mixer.

The raw material (B1) is obtained by sterilizing and then pulverizing the aroma component.

The raw material (B2) is obtained by dissolving the preservative in pure water.

Thus, carrying out the mixing step for mixing the raw material (A) and the raw material (B) makes it possible to form a sea-island structure in which a powder of the heat-meltable substance, with which the aromatic raw material is mixed, is dispersed in the aromatic base material 20.

Next, the mixture obtained in the mixing step is subjected to processing under compression/shearing and formed into a sheet form. The processing under compression/shearing can be carried out using, e.g., three rolls. Carrying out processing under compression/shearing using the three rolls makes it possible to mold the mixture into a sheet form while entraining air and vaporizing water.

A porous structure including air in the interior thereof is formed in the sheet obtained as described above. As a result, it is possible to obtain a low-density aromatic base material 20. Additionally, because the three rolls have very flat surfaces, the surface of the sheet is formed to be flat.

Specifically, due to having the porous structure including air in the interior thereof, the aromatic base material 20 has low density and is formed, in the processing under compression/shearing, such that the surfaces thereof are flat without any recesses or protrusions.

A cutting step is carried out in which the mixture formed into the sheet form in the processing under compression/shearing is cut to a prescribed shape and size. The sheet-form mixture is processed into, e.g., the form of a strip.

The first base material 21 can be created through the manufacturing method described above, except that the cannabinoid-containing substance from the raw material of the second base material 22 is excluded. The aromatic base material 20 including the first base material 21 and the second base material 22 created as described above is loaded into the cover 10 together with the filter 30 and the support member 40. Next, the cover 10 is curled so as to surround the other elements, and the end sections of the cover 10 are secured in place, whereby the aromatic cartridge 100 is manufactured.

Thus, the mixing step, the compression/shearing step, and the cutting step are carried out at temperatures below the melting point of the heat-meltable substance, thereby making it possible to prevent spreading of the aromatic base material 20 caused by melting of the heat-meltable substance and to maintain the sea-island structure of the heat-meltable substance in the aromatic base material 20.

When a sea-island structure is formed in which the powder of the heat-meltable substance, with which the aromatic raw material is mixed, is dispersed in the aromatic base material 20, the heat-meltable substance is dispersed in the aromatic base material 20 in the form of islands.

The heat-meltable substance flows more readily upon melting and more readily contains the aromatic component generated from the aromatic raw material when dispersed in the aromatic base material 20 in the form of islands than when the aromatic raw material is impregnated with the heat-meltable substance. The flowing heat-meltable substance also comes into contact with the aerosol former, and the aromatic component more readily becomes an aerosol and volatilizes together with the aerosol former.

As a result, the aromatic component of the aromatic raw material can volatilize more efficiently. Therefore, the user can more adequately savor the aroma when inhaling the aerosol emanating from the aromatic cartridge 100 immediately after completion of the process for raising the temperature of the heated smoking implement.

Figure 7:
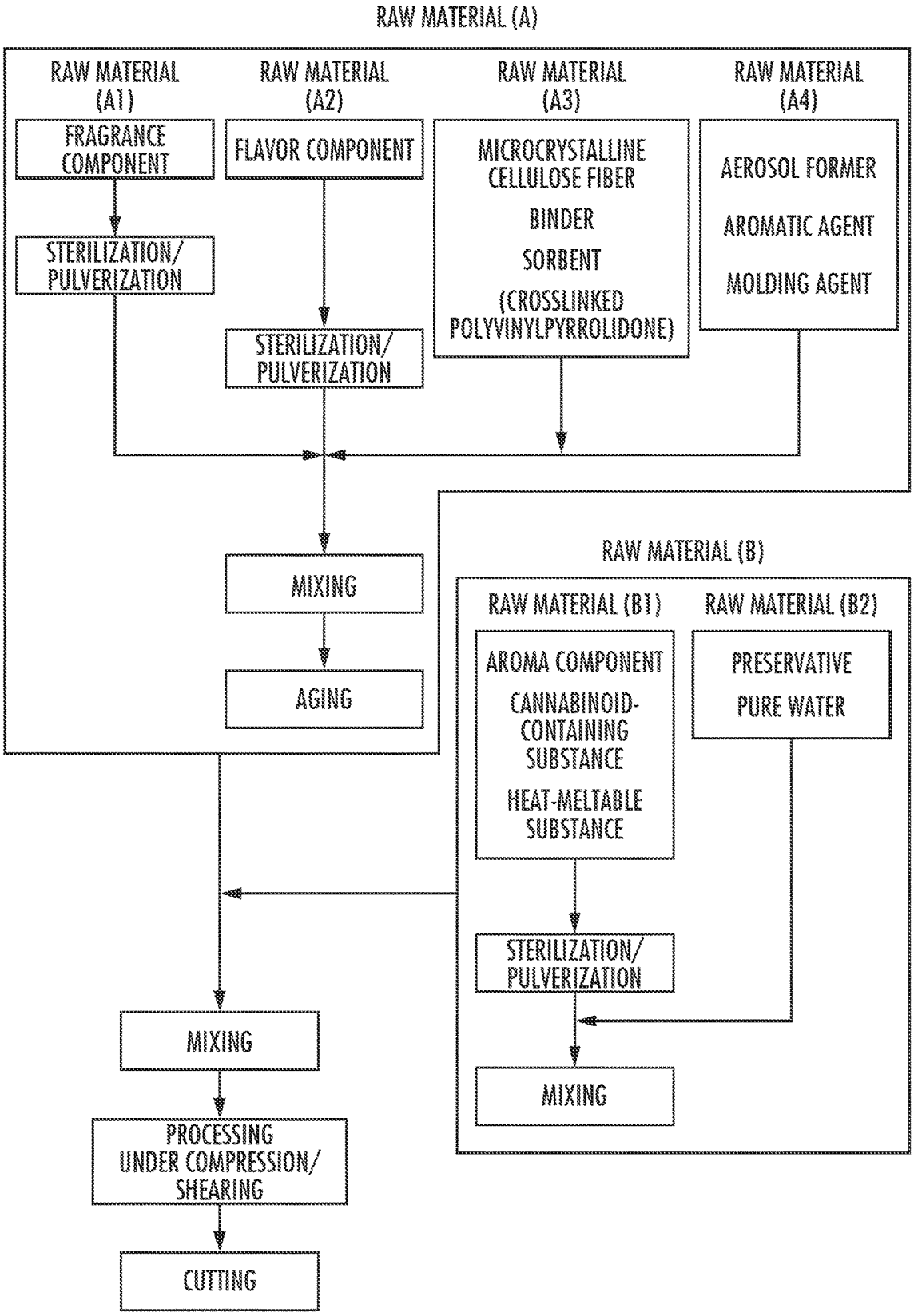
FIG. 7 is a flow chart showing other steps for manufacturing the aromatic base material in FIG. 1.

The cannabinoid-containing substance may be added to the raw material (B). FIG. 7 shows another embodiment of the steps for manufacturing the aromatic base material 20. As shown in FIG. 7, the cannabinoid-containing substance is preferably added to, e.g., the raw material (B1) when added to the raw material (B).

In such a case, it is preferable to create the raw material (B1) in the aspect shown in FIG. 7, i.e., by replacing the flavor component with the aroma component.

As described above, the aromatic cartridge 100 according to the present invention can contain the cannabinoid-containing substance in one location either as a liquid or solid, or in an encapsulated form, whereby the cannabinoid can be incorporated into the aerosol generated from the aromatic base material 20. As a result, the user can inhale the vaporized cannabinoid and the aromatic component generated from the aromatic base material 20 together with the aerosol and can anticipate the physiologically active effects of the cannabinoid, such as calming and painkilling actions, while enjoying the scent of the aromatic component.

Embodiment 2

The aromatic cartridge 100 according to embodiment 2 differs from aromatic cartridge 100 according to embodiment 1 in that, in the former, the cannabinoid-containing substance is contained in an encapsulated form. Portions that are identical in configuration to the aromatic cartridge 100 according to embodiment 1 are assigned identical reference symbols and are not redundantly described.

Figure 8:
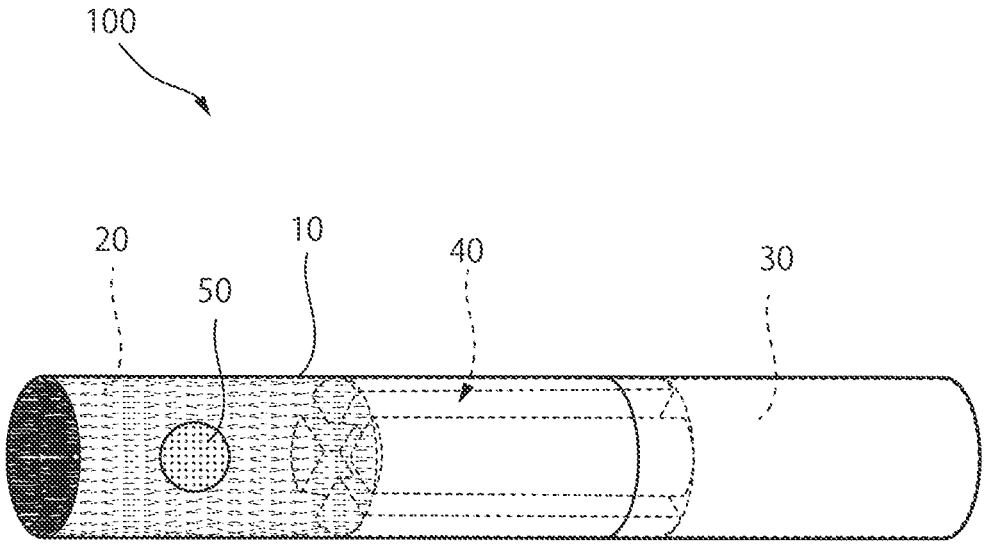
FIG. 8 is a perspective view of an aromatic cartridge according to embodiment 2.

FIG. 8 shows the aromatic cartridge 100 according to embodiment 2. As shown in FIG. 8, a capsule 50 in which the cannabinoid-containing substance is sealed is enveloped by the aromatic base material 20. More specifically, the capsule 50 is located centrally within the aromatic base material 20 in terms of the axial direction of the aromatic cartridge 100.

The aromatic base material 20 is preferably adjusted, as appropriate, in accordance with the shape and size of the capsule 50. The aromatic base material 20 is preferably formed as granules, a powder, or a paste when enveloping the capsule 50. Configuring the aromatic base material 20 in this manner makes it possible to more readily envelop the capsule 50.

The capsule 50 is, e.g., a seamless capsule. When the capsule 50 is crushed by being subjected to external force exerted by the user during smoking, or when the capsule 50 heated by the electric heating means of the inhalation implement, the liquid cannabinoid-containing substance sealed in the interior is released. For example, the capsule 50 ruptures due to the user, inter alia, pressing the cover 10 that accommodates the capsule 50, and the liquid cannabinoid-containing substance sealed inside the capsule 50 is released. In addition, the capsule 50 is pressed by the electric heating means, whereby a coating film of the capsule ruptures and the liquid cannabinoid-containing substance sealed inside the capsule 50 is released. Alternatively, the aromatic base material 20 is heated by the electric heating means of the inhalation implement, whereby a shell of the capsule 50 dissolves or ruptures and the liquid cannabinoid-containing substance sealed inside the capsule 50 is released.

In the capsule 50, a variety of materials can be used for the shell (outer cladding) for sealing the cannabinoid-containing substance. For example, a variety of shells that are typically used in the pharmaceutical industry can be used. Such a shell may be formed as a gelatin base or may be formed from a polymer material such as modified cellulose.

A liquid cannabinoid-containing substance in which a cannabinoid is dissolved in an oil and fat or an alcohol-based solvent, such as was described previously, can be used as the cannabinoid-containing substance sealed in the capsule 50.

For example, it is preferable to use a cannabinoid-containing substance in which the cannabinoid is dissolved in an alcohol-based solvent in a case where the capsule 50 is positioned at a location near the electric heating means when the aromatic cartridge 100 is inserted into the inhalation implement. When the electric heating means is heated, the alcohol-based solvent volatilizes, making it possible for the user to more efficaciously take in the cannabinoid.

Additionally, for example, it is preferable to use a cannabinoid-containing substance in which the cannabinoid is dissolved in an oil and fat solvent in a case where the capsule 50 is positioned at a location set apart from the electric heating means when the aromatic cartridge 100 is inserted into the inhalation implement. This makes it possible for the user to take in the cannabinoid together with the scent of the oil and fat.

Thus, incorporating the capsule 50 in which the cannabinoid-containing substance is sealed into the aromatic cartridge 100 makes it possible for the user to break the capsule 50 immediately before using the aromatic cartridge 100 and inhale the cannabinoid. Therefore, the user can anticipate the physiologically active effects of the cannabinoid, such as calming and painkilling actions, while enjoying the scent of the aromatic component. In addition, the cannabinoid-containing substance is retained in a state of filling the capsule, thereby making it easier to prevent denaturation of the cannabinoid during storage.

Embodiment 3

The aromatic cartridge 100 according to embodiment 3 differs from aromatic cartridge 100 according to embodiment 2 in terms of the positioning of the capsule 50 in which the cannabinoid-containing substance is sealed. Portions that are identical in configuration to the aromatic cartridge 100 according to embodiment 2 are assigned identical reference symbols and are not redundantly described.

Figure 9:
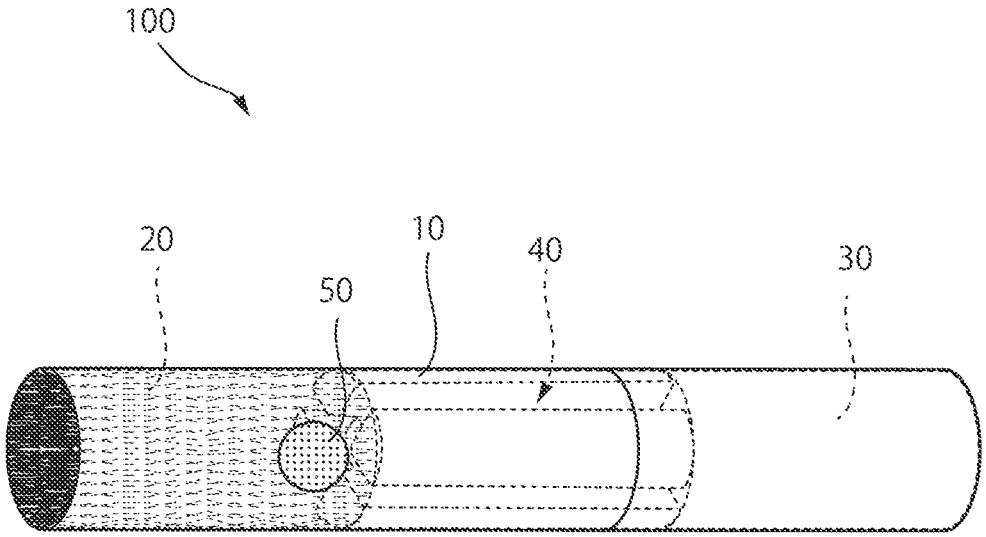
FIG. 9 is a perspective view of an aromatic cartridge according to embodiment 3.

FIG. 9 shows the aromatic cartridge 100 according to embodiment 3. As shown in FIG. 9, the capsule 50 in which the cannabinoid-containing substance is sealed is enveloped by the aromatic base material 20. More specifically, the capsule 50 is positioned in the aromatic base material 20 at a location near the support member 40.

This facilitates intermixing of the aromatic component volatilized through heating of the aromatic base material 20 and the cannabinoid released from the capsule 50 and makes it possible to facilitate inhalation of the cannabinoid together with the aromatic component. In addition, the volatilized cannabinoid is produced in a flow path of the aerosol, whereby the user can take in a higher concentration of the cannabinoid.

Embodiment 4

The aromatic cartridge 100 according to embodiment 4 differs from aromatic cartridge 100 according to embodiment 2 in terms of the aspect of the capsule 50 in which the cannabinoid-containing substance is sealed. Portions that are identical in configuration to the aromatic cartridge 100 according to embodiment 2 are assigned identical reference symbols and are not redundantly described.

Figure 10:
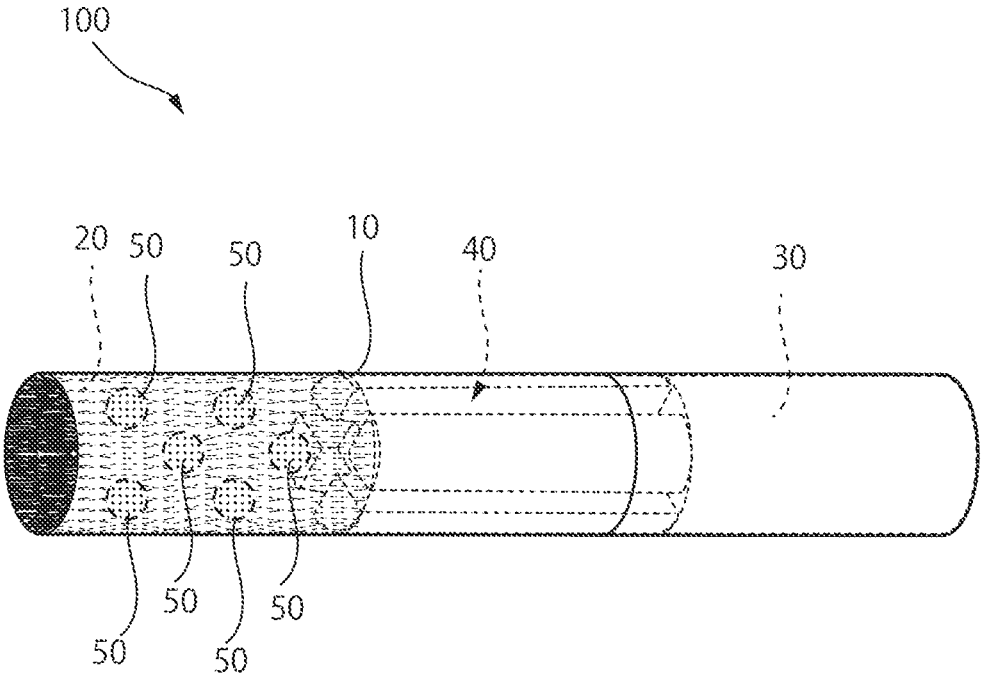
FIG. 10 is a perspective view of an aromatic cartridge according to embodiment 4.

FIG. 10 shows the aromatic cartridge 100 according to embodiment 4. As shown in FIG. 10, a plurality of capsules 50 in which the cannabinoid-containing substance is sealed are enveloped by the aromatic base material 20. More specifically, six capsules 50 are dispersed in the aromatic base material 20. The cannabinoid-containing substance is preferably sealed in at least one of the plurality of capsules 50. The refreshing agent, perfume, and other additives described above may also be sealed in the capsules 50.

The cannabinoid-containing substance thereby flows out from each of the plurality of capsules 50, wherefore the cannabinoid-containing substance can be allowed to uniformly flow out into the aromatic base material 20.

Embodiment 5

The aromatic cartridge 100 according to embodiment 5 differs from aromatic cartridge 100 according to embodiment 2 in terms of the positioning of the capsule 50 in which the cannabinoid-containing substance is sealed. Portions that are identical in configuration to the aromatic cartridge 100 according to embodiment 2 are assigned identical reference symbols and are not redundantly described.

Figure 11:
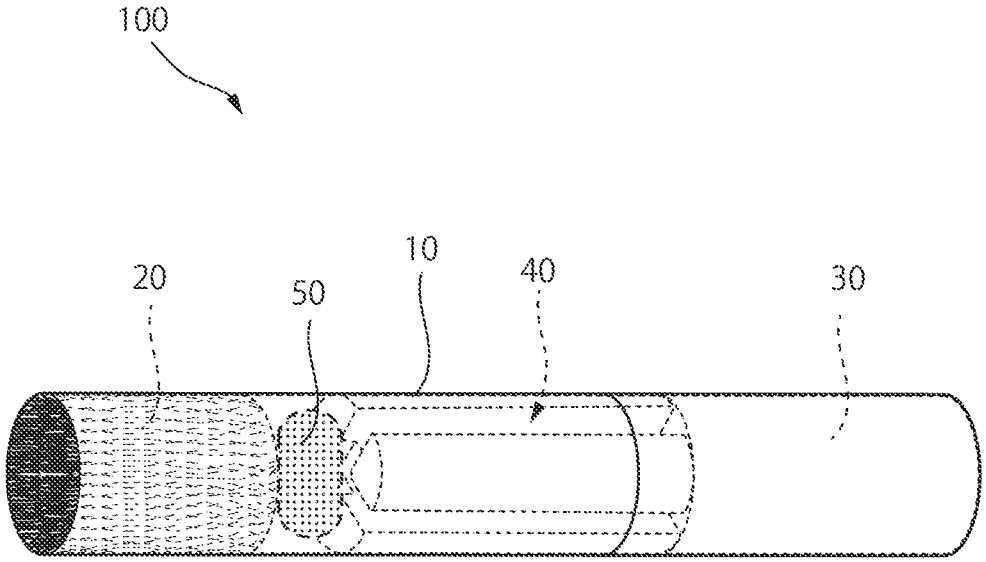
FIG. 11 is a perspective view of an aromatic cartridge according to embodiment 5.

FIG. 11 shows the aromatic cartridge 100 according to embodiment 5. As shown in FIG. 11, the capsule 50 in which the cannabinoid-containing substance is sealed is positioned between the aromatic base material 20 and the support member 40 in the axial direction of the aromatic cartridge 100. More specifically, in the present embodiment, the capsule 50 is formed as an ellipsoid. A gap for accommodating the capsule 50 is formed between the aromatic base material 20 and the support member 40.

The cannabinoid-containing substance flowing out from the capsule thus comes into contact with the aromatic component and aerosol generated from the aromatic base material 20, and the cannabinoid is readily contained in the aerosol at high concentrations, therefore making it possible to efficaciously inhale the cannabinoid.

Embodiment 6

The aromatic cartridge 100 according to embodiment 6 differs from aromatic cartridge 100 according to embodiment 5 in terms of the aspect of the capsule 50 in which the cannabinoid-containing substance is sealed. Portions that are identical in configuration to the aromatic cartridge 100 according to embodiment 5 are assigned identical reference symbols and are not redundantly described.

Figure 12:
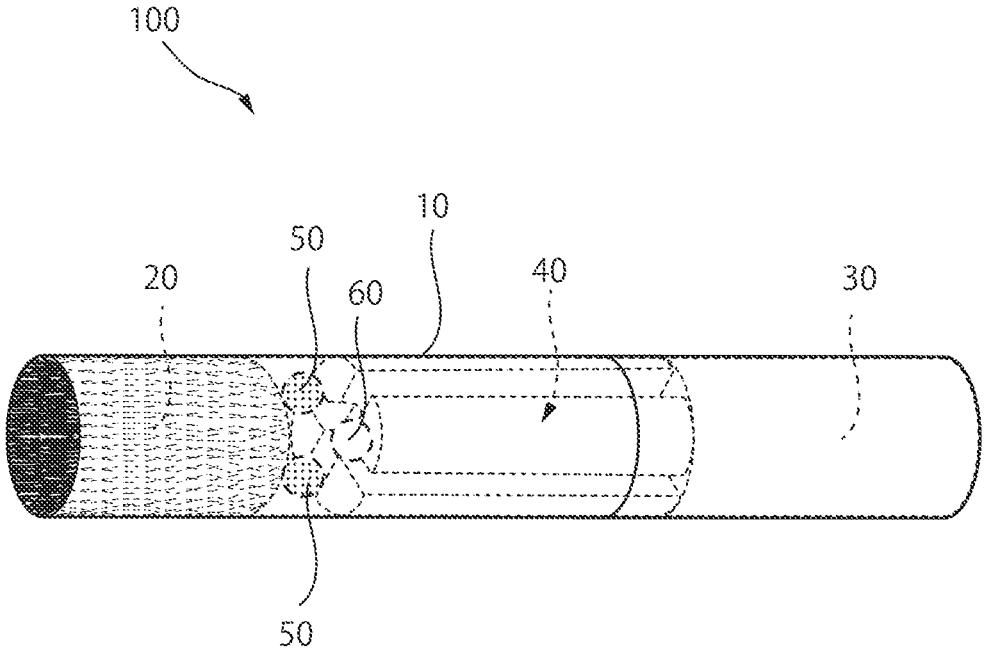
FIG. 12 is a perspective view of an aromatic cartridge according to embodiment 6.

FIG. 12 shows the aromatic cartridge 100 according to embodiment 6. As shown in FIG. 12, a gap is provided between the aromatic base material 20 and the support member 40 in the axial direction of the aromatic cartridge 100, and a plurality of capsules 50 in which the cannabinoid-containing substance is sealed and a mixing sphere 60 are positioned in the gap. More specifically, in the present embodiment, there are two capsules 50 formed as spheroids, and there is one mixing sphere 60. The cannabinoid-containing substance is preferably sealed in at least one of the two capsules 50. The refreshing agent, perfume, and other additives described above may also be sealed in the capsules 50.

The mixing sphere 60 is equivalent in size to the capsules 50 and is formed from a material harder than that of the capsules 50, e.g., is formed from resin.

Therefore, for example, when the user shakes the aromatic cartridge 100, the capsules 50 and the mixing sphere 60 collide in the gap. The capsules 50 are broken by the collision with the mixing sphere 60 and release the cannabinoid-containing substance.

Positioning the capsules 50 and the mixing sphere 60 in this manner makes it easier for the user to break the capsules 50.

Embodiment 7

The aromatic cartridge 100 according to embodiment 7 differs from aromatic cartridge 100 according to embodiment 5 in terms of the positioning of the capsule 50 in which the cannabinoid-containing substance is sealed. Portions that are identical in configuration to the aromatic cartridge 100 according to embodiment 5 are assigned identical reference symbols and are not redundantly described.

Figure 13:
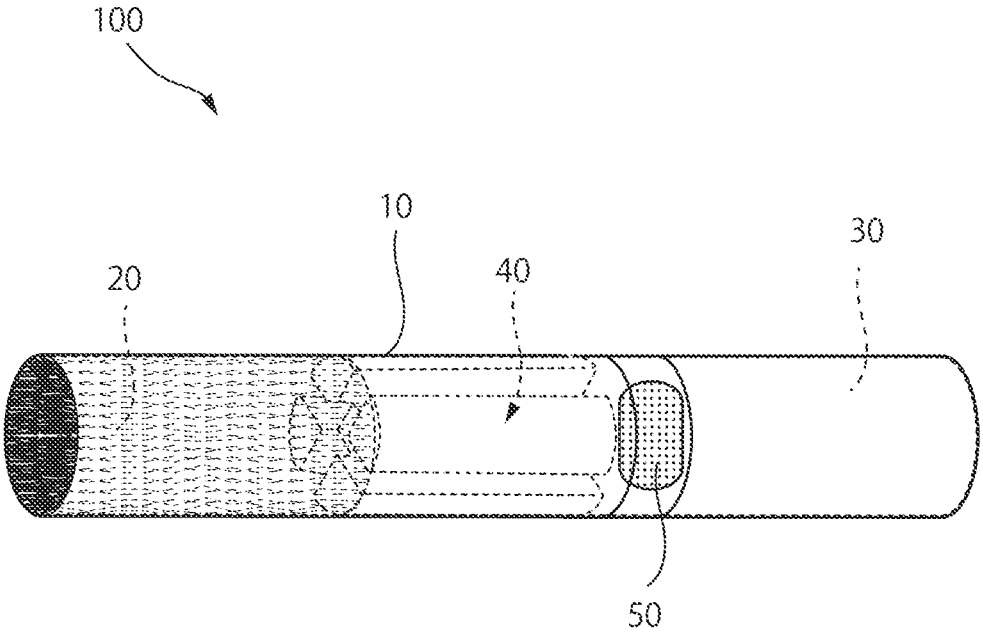
FIG. 13 is a perspective view of an aromatic cartridge according to embodiment 7.

FIG. 13 shows the aromatic cartridge according to embodiment 7. As shown in FIG. 13, a gap is formed between the support member 40 and the filter 30 in the axial direction of the aromatic cartridge 100. The capsule 50 in which the cannabinoid-containing substance is sealed is positioned in the gap. In the present embodiment, the capsule 50 is formed as an ellipsoid.

Thus, by disposing the capsule 50 between the support member 40 and the filter 30, it will be easier for the filter 30 to be impregnated with the cannabinoid-containing substance when the capsule 50 is broken, and it will be possible to inhale the cannabinoid-containing substance in high concentrations through the filter 30. Specifically, because the capsule 50 is positioned near the filter 30, which is on the mouthpiece side, the user can take in the cannabinoid at higher concentrations.

Embodiment 8

The aromatic cartridge 100 according to embodiment 8 differs from aromatic cartridge 100 according to embodiment 1 in terms of the aspect in which the cannabinoid-containing substance is contained. Portions that are identical in configuration to the aromatic cartridge 100 according to embodiment 1 are assigned identical reference symbols and are not redundantly described.

Figure 14:
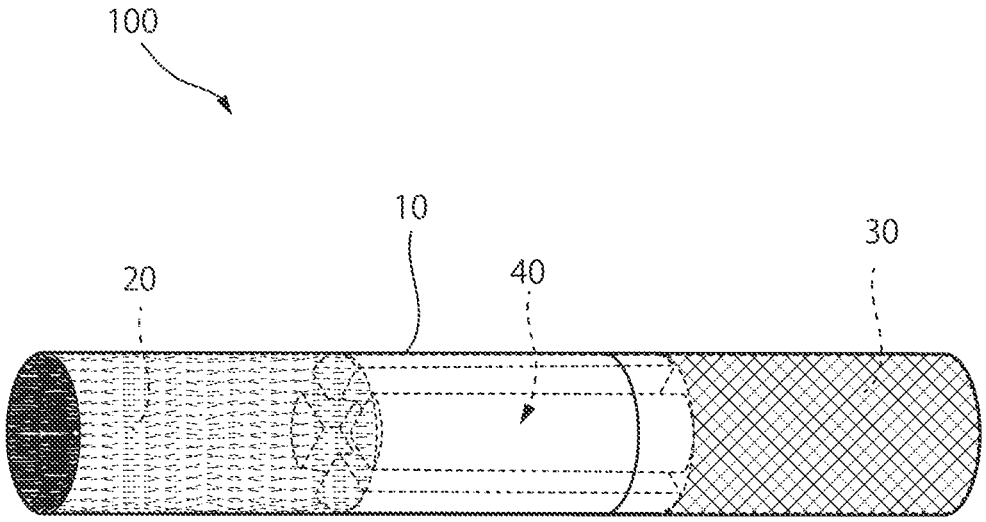
FIG. 14 is a perspective view of an aromatic cartridge according to embodiment 8.

FIG. 14 shows the aromatic cartridge 100 according to embodiment 8. As shown in FIG. 14, the cannabinoid-containing substance is contained in the filter 30.

Such a filter 30 can be created by, e.g., impregnating the filter 30 with the liquid cannabinoid-containing substance and then drying the filter 30. The filter 30 is not limited to this aspect; for example, the filter 30 can instead be created by dispersing the powder-form cannabinoid-containing substance in the filter 30.

Thus, by incorporating the cannabinoid-containing substance into the filter 30, it will be possible to avoid the effects of the heat of the aromatic base material 20, which is heated at high temperature, to the greatest extent possible and inhale the cannabinoid generated from the cannabinoid-containing substance.

The cannabinoid-containing substance may be provided to the cover 10 for covering the outer peripheral section of the filter 30. In such a case, the cannabinoid-containing substance is preferably provided to the tip paper 13 of the cover 10.

When the cannabinoid-containing substance is provided to the tip paper 13, the tip paper 13 is preferably impregnated with the liquid cannabinoid-containing substance described above and then dried.

Therefore, the tip paper 13 impregnated with the cannabinoid-containing substance will touch the lips of the user when the user holds the aromatic cartridge 100 in their mouth. The cannabinoid-containing substance is then taken into the body of the user through the lips. Thus, the user can anticipate the physiologically active effects of the cannabinoid, such as calming and painkilling actions, even if the user takes in the cannabinoid-containing substance through the skin, i.e., the lips.

When the cannabinoid-containing substance is provided to the tip paper 13, it is preferable to use the filter 30 impregnated with the cannabinoid-containing substance. When using the aromatic cartridge 100, the user can take in the cannabinoid included in the mainstream smoke and take in the cannabinoid through the lips. The cannabinoid volatilized from the filter 30 also soaks into the tip paper 13, whereby the concentration of cannabinoid in the tip paper 13 increases and it is possible to promote intake of the cannabinoid through the skin.

Embodiment 9

The aromatic cartridge 100 according to embodiment 9 differs from aromatic cartridge 100 according to embodiment 8 in terms of the aspect in which the cannabinoid-containing substance is contained. Portions that are identical in configuration to the aromatic cartridge 100 according to embodiment 8 are assigned identical reference symbols and are not redundantly described.

Figure 15:
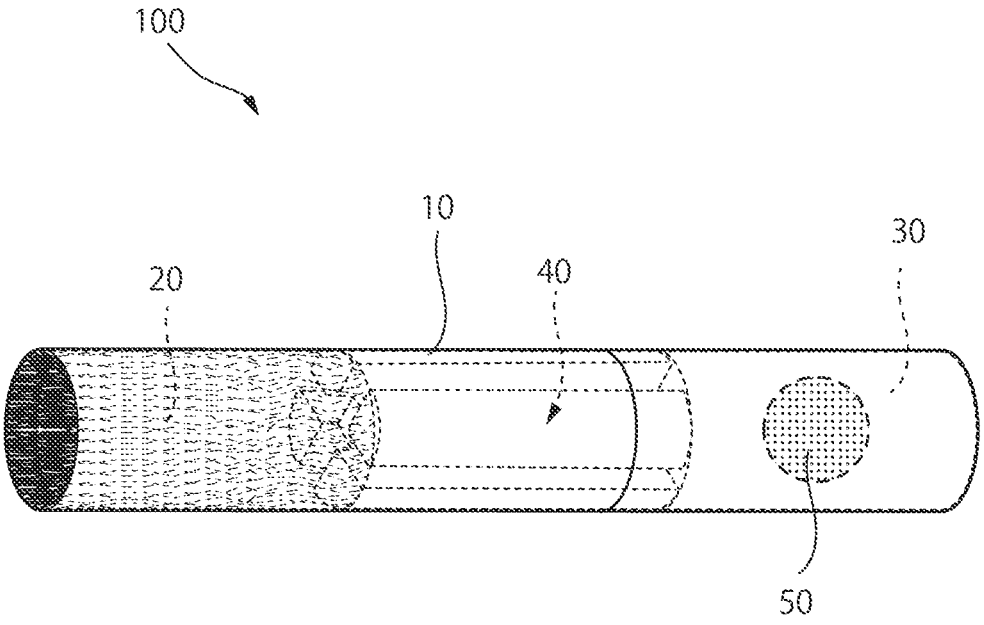
FIG. 15 is a perspective view of an aromatic cartridge according to embodiment 9.

FIG. 15 shows the aromatic cartridge 100 according to embodiment 9. As shown in FIG. 15, the capsule 50 in which the cannabinoid-containing substance is sealed is enveloped by the filter 30. More specifically, the capsule 50 is located centrally within the filter 30 in terms of the axial direction of the aromatic cartridge 100.

There is no particular limitation as to the size of the capsule 50 positioned in the filter 30; on being installed, the capsule 50 can be larger than the capsules in the embodiments described above. Specifically, when a capsule 50 positioned in the aromatic base material 20 is increased in size, the amount of aromatic base material 20 will decrease. Additionally, in a case where the capsule 50 is positioned in a space as described above, when the capsule is increased in size, the space must be commensurately formed larger; therefore, the axial-direction length of the aromatic cartridge 100 increases. However, in a case where the capsule 50 is positioned in the filter 30, such issues do not arise, therefore making it possible to dispose a capsule that larger than a capsule positioned at other locations.

Thus, encapsulating the capsule 50 in the filter 30 makes it possible to facilitate breakage of the capsule 50 through pinching of the filter 30 and makes it possible to efficaciously impregnate the filter 30 with the cannabinoid-containing substance flowing out once the capsule 50 is broken.

Figure 16:
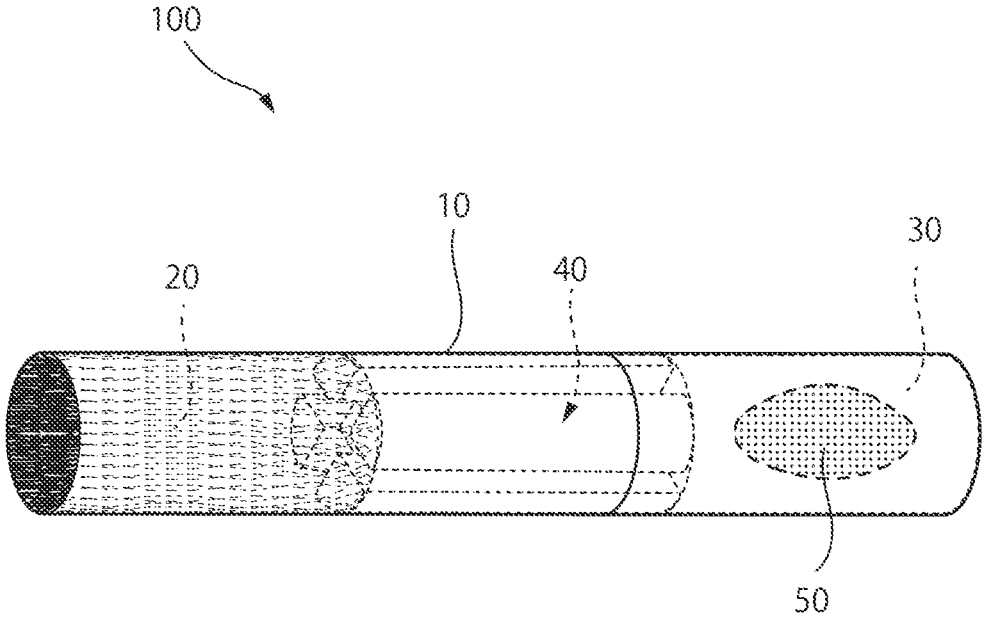
FIG. 16 is a perspective view of the aromatic cartridge according to embodiment 9, said perspective view showing another form of capsule.

The capsule 50 is not limited to being spherical; for example, the capsule 50 may be formed in an ellipsoidal shape, as shown in FIG. 16. Forming the capsule 50 as an ellipsoid makes it possible to seal a greater amount of the cannabinoid-containing substance into the capsule 50. Additionally, because the length of the capsule 50 increases, it is possible to facilitate breakage of the capsule 50 under pressing by a finger.

The cannabinoid-containing substance may be included in a material other than a capsule. For example, it is also permissible to use an article in which a sponge material made of polyurethane or the like, or a porous material made of pumice or the like, is impregnated with the liquid cannabinoid-containing substance. Thus, by impregnating a sponge material or porous material with the cannabinoid-containing substance, it will be possible to increase the amount of the cannabinoid-containing substance used to a greater extent than when the aromatic base material 20 is impregnated therewith. Additionally, it will be possible to create the aromatic cartridge 100 more easily than when the cannabinoid-containing substance is enveloped by the capsule 50.

EXAMPLES

(Test Example 1) (Sensory Evaluation of Flavor)

An aromatic base material including a cannabinoid-containing substance and crosslinked polyvinylpyrrolidone was created as an example, an aromatic base material lacking at least one of the cannabinoid-containing substance and the crosslinked polyvinylpyrrolidone was created as a comparative example, and the flavor of aerosols from the example and comparative example was evaluated.

Production of Specimen: Example 1

An aromatic cartridge 100 according to example 1 was created using the blend shown in table 1. Specifically, a blend of aromatic raw materials (aroma component, fragrance component, and flavor component), cannabinoid-containing substance, aerosol former, and heat-meltable substance was employed as a basic blend. In example 1, the basic blend contained 65 mass % of the aromatic raw materials and the cannabinoid-containing substance, 25 mass % of the aerosol former, and 10 mass of the heat-meltable substance.

15 parts by mass of an aromatic agent, 23 parts by mass of a binder, 21 parts by mass of a sorbent, 0.005 parts by mass of a preservative, and 20 parts by mass of pure water were added to 100 parts by mass of the basic blend to create the aromatic cartridge 100 according to example 1. Pure water was added for the purpose of molding, but removed through drying after the molding.

TABLE 1

| | | | Component | Mass % | Parts by mass |
|---|---|---|---|---|---|
| Raw material (B) | Raw material (B1) | Aroma component | Powdered konjac | 65 | 100 |
| Raw material (A) | Raw material (A1) | Fragrance component | Black tea | | |
| | Raw material (A1) | Fragrance component | Osmanthus flower | | |
| | Raw material (A2) | Flavor component | Jiaogulan | | |
| | Raw material (A2) | Cannabinoid-containing substance | Cannabidiol (powder) | | |
| | Raw material (A4) | Aerosol former | Glycerin<br>Propylene glycol | 25 | |
| | Raw material (A2) | Heat-meltable substance | Beeswax | 10 | |
| | Raw material (A4) | Aromatic agent | Mint oil<br>Menthol | | 15 |
| | Raw material (A3) | Binder | Sodium salt of CMC<br>Sugarcane fiber | | 23 |
| | Raw material (A3) | Sorbent | Crosslinked polyvinylpyrrolidone<br>β-cyclodextrin | | 21 |
| Raw material (B) | Raw material (B2) | Preservative | Potassium sorbate<br>Sodium benzoate | | 0.005 |
| | Raw material (B2) | Pure water | | | 20 |

For the aromatic raw materials, powdered konjac was used as an aroma component in raw material (B1), black tea and *Osmanthus* flower were used as fragrance components in raw material (A1), and jiaogulan was used as a flavor component in raw material (A2).

Glycerin and propylene glycol were used as aerosol formers in raw material (A4).

Beeswax was used as a heat-meltable substance in raw material (A2).

Mint oil and menthol were used as aromatic agents in raw material (A4).

A sodium salt of CMC and sugarcane fiber were used as binders in raw material (A3).

Crosslinked polyvinylpyrrolidone and β-cyclodextrin were used as sorbents in raw material (A3).

Potassium sorbate and sodium benzoate were used as preservatives in raw material (B2).

aromatic base material was cut off to a length of 11.5-12.0 mm and then dried, whereby the aromatic cartridge 100 was manufactured.

Production of Comparative Example 1

An aromatic cartridge 100 according to comparative example 1 was created using the blend shown in table 2. Comparative example 1 differed from example 1 in not including the cannabinoid-containing substance of raw material (A2). Comparative example 1 was otherwise identical to example 1, and therefore the raw materials and manufacturing method therefor are not redundantly described.

TABLE 2

| | | | Component | Mass % | Parts by mass |
|---|---|---|---|---|---|
| Raw material (B) | Raw material (B1) | Aroma component | Powdered konjac | 65 | 100 |
| Raw material (A) | Raw material (A1) | Fragrance component | Black tea | | |
| | Raw material (A1) | Fragrance component | Osmanthus flower | | |
| | Raw material (A2) | Flavor component | Jiaogulan | | |
| | Raw material (A4) | Aerosol former | Glycerin<br>Propylene glycol | 25 | |
| | Raw material (A2) | Heat-meltable substance | Beeswax | 10 | |
| | Raw material (A4) | Aromatic agent | Coffee powder | | 15 |
| | Raw material (A3) | Binder | Sodium salt of CMC<br>Sugarcane fiber | | 23 |
| | Raw material (A3) | Sorbent | Crosslinked polyvinylpyrrolidone<br>β-cyclodextrin | | 21 |
| Raw material (B) | Raw material (B2) | Preservative | Potassium sorbate<br>Sodium benzoate | | 0.005 |
| | Raw material (B2) | | Pure water | | 20 |

Raw materials (A1) and (A2) were created using the aspect shown in FIG. 6. Specifically, the raw material (A1) was obtained by sterilizing the fragrance component and then pulverizing the sterilized fragrance component into the form of a powder. The raw material (A2) was formulated by coarsely mixing the cannabidiol (CBD/Polyphenol Resin) (made by Yunnan Hansu Biotechnology Co., Ltd.; production code: PR001) and the heat-meltable substance using a Henschel mixer, subsequently mixing the coarse mixture under compressing/shearing, cooling the mixture to 0° C. or lower, and then pulverizing the cooled article. The raw materials (A1) and (A2) were also classified to an average grain diameter of about 250 μm using an 80-mesh sieve.

In the aspect shown in FIG. 6, the aromatic cartridge 100 was formulated using the raw materials (A) and (B). Specifically, a mixing step was carried out in which the raw materials (A) and (B) were mixed using a kneader.

Next, a compression/shearing step was carried out in which the mixture was molded into the form of a sheet using three rolls. In the compression/shearing step, the mixture was molded into the form of a sheet having a thickness of 0.28±0.02 mm. The compression/shearing step was carried out at a temperature equal to or below the melting point of the beeswax.

A cutting step for cutting the sheet was then carried out. In the cutting step, the sheet was cut to a width of 1.5±0.1 mm and a length of about 240 mm.

The aromatic base material obtained as described above was rolled to achieve a prescribed filling ratio. The rolled (Sensory Examination)

The flavor of aerosols from the aromatic cartridges 100 according to example 1 and comparative example 1 was evaluated by ten panel experts using heated smoking implements.

Eight of the ten panel experts assessed that the aromatic cartridge 100 according to example 1 yielded a more relaxing effect, i.e., calming action, as well as greater utility such as a painkilling action, than the aromatic cartridge 100 according to comparative example 1.

KEY

100 Aromatic cartridge
10 Cover
20 Aromatic base material
30 Filter
40 Support member
50 Capsule

The invention claimed is:

1. An aromatic cartridge that is mounted in an inhalation implement having an electric heating means and that generates an aerosol through being heated by the electric heating means, characterized by having a tubular cover, an aromatic base material that is accommodated in one end of the cover and that generates an aromatic-component-containing aerosol through being heated, a filter that is accommodated in the other end of the cover, and a cannabinoid-containing substance, the aromatic cartridge containing the cannabinoid-containing substance in one or more locations either as a liquid or solid, or in an encapsulated form, wherein the aromatic cartridge includes the tubular cover, the aromatic base material, the filter, and a support member disposed between the aromatic base material and the filter, and the cannabinoid-containing substance is disposed in an encapsulated form in at least one location selected from among (a) inside the aromatic base material, (b) between the aromatic base material and the support member, (c) inside the support member, (d) between the support member and the filter, and (e) inside the filter.

2. The aromatic cartridge according to claim 1, wherein the cannabinoid contained in the cannabinoid-containing substance is cannabidiol.

3. The aromatic cartridge according to claim 1, which contains at least one selected from menthol, caffeine, catechins, and perfumes in addition to the cannabinoid-containing substance.

4. An aromatic cartridge that is mounted in an inhalation implement having an electric heating means and that generates an aerosol through being heated by the electric heating means, characterized by having a tubular cover, an aromatic base material that is accommodated in one end of the cover and that generates an aromatic-component-containing aerosol through being heated, a filter that is accommodated in the other end of the cover, and a cannabinoid-containing substance, the aromatic cartridge containing the cannabinoid-containing substance in one or more locations either as a liquid or solid, or in an encapsulated form, wherein the cannabinoid-containing substance is contained dissolved in a solvent selected from oils and fats and alcohol-based solvents.

5. The aromatic cartridge according to claim 2, which contains at least one selected from menthol, caffeine, catechins, and perfumes in addition to the cannabinoid-containing substance.

6. The aromatic cartridge according to claim 4, which contains at least one selected from menthol, caffeine, catechins, and perfumes in addition to the cannabinoid-containing substance.

* * * * *